US005893019A

United States Patent [19]

Yoda et al.

[11] Patent Number: 5,893,019

[45] Date of Patent: Apr. 6, 1999

[54] FUSING DEVICE WITH ROLLERS HAVING DIFFERENT SPEEDS, AND IMAGE FORMING APPARATUS USING SAME

[75] Inventors: Kaneo Yoda; Hiroshi Tanaka; Kenjiro Yoshioka; Saburo Furukawa, all of Nagano, Japan

[73] Assignee: Seiko Epson Corporation, Tokyo, Japan

[21] Appl. No.: 892,973

[22] Filed: Jul. 15, 1997

[30] Foreign Application Priority Data

Jul. 15, 1996 [JP] Japan ..... 8-185201
Jan. 27, 1997 [JP] Japan ..... 9-012921

[51] Int. Cl.[6] ..... G03G 15/26

[52] U.S. Cl. ..... 399/321; 399/328; 399/331; 219/216

[58] Field of Search ..... 399/45, 321, 322, 399/323, 328, 331; 219/216

[56] References Cited

U.S. PATENT DOCUMENTS

| | | | |
|---|---|---|---|
| 4,714,427 | 12/1987 | Tsuruoka et al. | 432/59 |
| 4,967,237 | 10/1990 | Sasaki et al. | 399/322 |
| 5,099,289 | 3/1992 | Kurotori et al. | 355/290 |
| 5,255,060 | 10/1993 | Chikano | 355/290 |

FOREIGN PATENT DOCUMENTS

| | | |
|---|---|---|
| 0 046 849 | 3/1982 | European Pat. Off. . |
| 195 19 458 | 11/1995 | Germany . |
| 55-29822 | 3/1980 | Japan . |
| 57-46273 | 3/1982 | Japan . |
| 60-88358 [U] | 6/1985 | Japan . |
| 63-274968 | 11/1988 | Japan . |
| 01037580 | 2/1989 | Japan . |
| 2-143282 | 6/1990 | Japan . |
| 4-63388 | 2/1992 | Japan . |
| 6-202520 | 7/1994 | Japan . |

OTHER PUBLICATIONS

European Search Report.
IBM Technical Disclosure Bulletin, vol. 33, No. 12, 1 May 1991, pp. 234–236.

*Primary Examiner*—Joan Pendegrass
*Attorney, Agent, or Firm*—Sughrue, Mion, Zinn Macpeak & Seas, PLLC

[57] ABSTRACT

In a fusing device having first to third rollers, the first and second rollers are forcibly driven so that a peripheral speed of the third roller is higher than of the first roller. Further, a movable guide is set so as to change the number of nip portions through which a recording medium passes.

20 Claims, 9 Drawing Sheets

FUSING DEVICE WITH ROLLERS HAVING DIFFERENT SPEEDS, AND IMAGE FORMING APPARATUS USING SAME

BACKGROUND OF THE INVENTION

1. Field of the Invention

The present invention relates to a fusing device incorporated into an image forming apparatus, used for fusing a toner image formed on a recording medium.

2. Description of the Prior Art

Concerning a conventional method for fusing a toner image formed on a recording sheet, there is provided a nip portion between a pair of rollers, wherein one is a heating roller and the other is a pressurizing roller coming into pressure contact with the heating roller, and the recording sheet on which an unfused toner image is formed is made to pass through the nip portion, so that the toner image can be thermally fused on the recording sheet. Recently, there is a tendency that the processing speed of an image forming apparatus is remarkably increased. Also, there is a tendency that the color image forming apparatus has been widely used. Especially when a multi-color image is fused on a recording sheet, it is necessary to ensure a stable coloring property of the fused color image.

Ensuring a stable coloring property of the fused color image can be accomplished when the masking of a lower toner layer conducted by an upper toner layer is removed. The masking of the lower toner layer conducted by the upper toner layer can be substantially removed as follows. The toner layer is heated and fused by a fusing device. At the same time, the toner layer is given a high pressure by the fusing device, so that voids formed on the toner layer can be reduced, and the toner layer is compressed to be a thin layer. As a result, the upper toner layer color and the lower toner layer color are appropriately mixed with each other. Therefore, it is possible to accomplish an excellent coloring property. Even if, a small toner grain boundary exists at this time, the coloring property is not affected. In this connection, since voids on the toner layer are reduced, the toner layer surface is made to be flat, so that the fused toner image becomes glossy. It is possible to change the glossiness in a range from a value not less than 5 to a value smaller than 20 when the heating and fusing time of the toner layer is changed and also the compressing time is changed while the coloring property is maintained high.

In the case where a multi-color image is fused on a transparent sheet, it is necessary to provide a high transparence. It is possible to realize a high transparence by preventing light from diffusing on the toner layer.

In order to prevent light from diffusing on the toner layer, it is necessary to heat, fuse and compress the toner layer while a longer time than that required for fusing the multi-color image on a recording sheet is taken, so that the voids and the grain boundary on the toner image, which are the causes of diffusion of light, can be removed and so that the toner layer surface can be made as flat as a mirror surface. In this connection, the glossiness can be changed by a value not less than 20 while a high transparence is maintained.

In the case where a monochromatic image is fused on a recording sheet or alternatively a black image is fused on a transparent sheet, it is sufficient that the adhesive strength of the toner layer onto a recording sheet is ensured. Accordingly, in this case, a period of time required for heating, fusing and compressing the toner layer may be shorter than that required for fusing a multi-color image on a transparent sheet described above. In this case, since the toner image contains a number of voids, there are irregularities on the surface, and the glossiness can be changed by a value smaller than 5 while the adhesive strength is ensured.

Accordingly, when the multi-color image is fused, it is necessary to heat, fuse and compress the toner layer while a longer period of time than that of a case of fusing a monochromatic image is taken. Therefore, in order to fuse a multi-color image by the conventional fusing device composed of a pair of rollers, it is necessary to decrease the passing speed of a recording sheet, or alternatively it is necessary to increase a width of the nip portion so that a period of time in which the toner layer on a recording sheet passes through the nip portion can be extended.

However, the method of decreasing the passing speed of a recording sheet is against the tendency of increasing the processing speed. Also, the method of increasing the width of the nip portion by extending a roller diameter is disadvantageous in that the size of the image forming apparatus can not be decreased. Also, the method of increasing a contact force of the pressurizing roller with the heating roller is disadvantageous in that the nip portion width can not be extended so long and the toner layer of a multi-color image can not be sufficiently heated and fused, and further the durability of rollers is deteriorated and wrinkles are caused on a recording sheet.

In order to solve the above problems, Japanese Patent Publication No. Sho. 55-29822 discloses the following method. An endless belt is trained round two pressurizing rollers, and the endless belt is made to come into pressure contact with one heating roller, so that a longer nip width can be provided. Also, the following method is disclosed. Two pressurizing rollers are made to come into pressure contact with one heating roller, and a stationary guide mechanism is arranged between the two pressurizing rollers while the stationary guide mechanism is separate from the heating roller, so that a recording sheet can be contacted with the heating roller. Due to the above arrangement, the number of the nip portions is increased, so that a period of time for heating, fusing and compressing the toner layer can be increased.

However, according to the method disclosed in Japanese Publication No. Sho. 55-29822 in which the nip portion width is extended by making the endless belt to come into pressure contact with the heating rollers, a contact force of the pressurizing roller with the heating roller via the endless belt is set at a low value so that wrinkles or elongation can not be caused on the endless belt. Consequently, an intensity of the contact force of the endless belt with the heating roller is maintained low. For this reason, the toner layer is not sufficiently compressed. Accordingly, in the case of fusing a multi-color image, the masking of the lower toner layer conducted by the upper toner layer can not be sufficiently removed, and the coloring property is deteriorated.

When toner (sharply melted toner), the fusing point of which is lower than that of common toner, is used to solve the above problem, toner tends to adhere onto a restricting blade and a cleaning blade of the developing unit of the electrophotographic apparatus. As a result, defective images tend to occur, and further cleaning can not be appropriately to carried out, so that the durability is deteriorated. Furthermore, it is difficult to rotate the endless belt at high speed without vibration and slippage onto one side. Consequently, it is difficult to highly increase the processing speed of the image forming apparatus.

In the arrangement disclosed in Japanese Patent Publication No. Sho. 55-29822 in which two pressurizing rollers are made to come into pressure contact with one heating roller, a stationary guide mechanism is arranged between the two pressurizing rollers while being separate from the heating roller, so that the following problems occurred. That is, the fusing device comprises a first roller (a heating roller as a heating member) for heating a recording medium or a recording sheet of paper, a second roller (a pressurizing roller as a pressurizing member) pressed against the first roller to form a first nip portion at a two-dimensional area of contact therebetween, and a third roller (a pressurizing roller as a pressurizing member) pressed against the first roller to form a second nip portion at a two-dimensional area of contact therebetween. The fusing device heats, fuses and permanently fixes a toner powder image formed on the recording sheet by passing the recording sheet through the first nip portion and the second nip portion. In the roller arrangement of the fusing device, the second and third rollers are turned by the first roller with the aid of frictions each between the peripheral surfaces of the adjacent rollers.

In the fusing device thus constructed, the outer peripheral surface of the second roller is softer than of the first roller. The or surface of the third roller is harder than of the first roller. A contact pressure in the nip portion causes a surface expansion therein, and a transfer of a torque through the nip develops a shearing stress. When the surface of the roller moves out of the nip, the surface contracts, and a peripheral speed of the roller decreases. A peripheral speed of one roller whose surface is more deformable is lower than of the other whose surface is less deformable. In the prior art, the second roller is slower than the third roller when these rollers turn.

In the three-roller fusing device, when the roller diameter or the recording sheet thickness is varied, a quantity of deformation of the roller varies, and hence a distance from the roller center to the roller surface also varies. This possibly causes a variation of the roller transporting speed.

Also when a coating amount of oil and/or roller temperature varies transporting force is varied. Sometimes, this entails an, and a frictional force on the roller surface varies, a substrate instable relative shift between the roller surface and the copy sheet.

In the three-roller fusing device disclosed, the second and third rollers serve as follower rollers. Because of this, the fusing device suffers from the following disadvantage. The transport speed of the third roller is varied by 1) the thickness of the recording medium, 2) the surface conditions of the second and third rollers, for example, oil coating conditions, and 3) temperature of the first to third rollers. The variation of the transport speed of the third roller makes it difficult to keep the peripheral speed of the third roller higher than of the second roller.

When the transport speed is instable, the recording medium is sometimes slackened between the second roller and the third roller. In this case, the recording medium is detached from the first roller between the second roller and the third roller, and there will not be enough heat transfer to deteriorate the fusing/fixing performance. Further, if the slackening of the recording medium is further increased, a tension of the recording medium in the roller axis direction is lost, so that a gentle undulation of the recording medium tends to occur in the roller axis direction. When the roll pair receives the undulated recording medium in the second nip portion, the recording medium is wrinkled. When the wrinkles of the recording medium become heavy, a torque for the paper transport rapidly increases. When the transport torque exceeds the torque by the drive source, the paper transporting operation stops, causing paper jams.

Further, it is difficult to remove a recording sheet in the occurrence of paper jams in which the fusing device is jammed by the recording sheet, since the stationary guide obstructs the operation of jam clearance.

On the other hand, the subjective judgment of beauty and preference on an electrophotographic image is greatly affected by a combination of the glossiness of a toner image with the surface property of a recording sheet. There are various types of recording sheets. Examples of usable recording sheets are: rough paper such as reclaimed paper and bond paper, the surface of which is rough, and the glossiness of which is low; plain paper, the glossiness of which is intermediate; and smooth paper, the surface of which is smooth and glossy. Inventors made investigation into the glossiness of images and recording sheets and the subjective values of evaluation while the fusing conditions were variously changed and images of various glossiness were printed and fused on recording sheets of various surface roughness. As a result of the investigation, it can be concluded that the smaller the difference between the glossiness of images and the glossiness of recording sheets which are the background of the images, the higher the subjective values of evaluation. In other words, there is a tendency that the subjective values are high when the glossiness of an image is the same as the glossiness of the background. That is, a mat surface, the glossiness of which is low (the glossiness is lower than 5), is suitable for rough paper. A gloss surface, the glossiness of which is high (the glossiness is not lower than 20), is suitable for smooth paper. The intermediate glossiness (not lower than 5, and lower than 20) is suitable for paper of the intermediate surface roughness.

However, in some cases, images of high glossiness or images of low glossiness are preferred irrespective of the surface roughness of recording sheets. For the above reasons, in order to meet the demands of all users, it is preferable that the glossiness can be arbitrarily selected in accordance with their preference.

In the conventional fusing system in which periods of time to heat, fuse and compress a toner layer are set at constant values, in order to fuse monochromatic images or multi-color images on various recording sheets, it is necessary that the periods of time to heat, fuse and compress a toner layer are set in accordance with the fusing conditions for fusing a multi-color image on a transparent sheet, wherein the periods of time to heat, fuse and compress a toner layer are the longest when a multi-color image is fused on a transparent sheet.

However, the following problems may be encountered in the above conventional fusing system. As described before, the glossiness of an image is increased to a value not lower than 20 at that time. Therefore, especially when rough paper is used as a recording sheet, the glossiness of an image and the glossiness of the background are greatly different from each other, and everybody feels a sense of incongruity. Even when a user likes an image of low glossiness, only an image of high glossiness is provided.

According to the method in which the glossiness is changed when a pushing force of the pressurizing roller to the heating roller is changed, an amount of change in the width of the nip portion is small. Therefore, an amount of change in the period of time of heating, fusing and compressing a toner layer is small. Accordingly, the glossiness can be changed only in a range from the intermediate glossiness to the high glossiness (from 10 to 20). Consequently, everybody feels as sense of incongruity when the toner image is fused on rough paper. Even when a highly accurate pressurizing roller and heating roller are used, they have a small camber and further their diameters fluctuate in the longitudinal direction. Accordingly, the width of the nip portion fluctuates when these rollers are rotated. When a pushing force of the pressurizing roller to the heating roller is reduced, the fluctuation of the width of the nip portion affects the average width of the nip portion, and unevenness of fusing becomes remarkable.

In an arrangement in which a belt is made to come into pressure contact with a heating roller, when the contact width (the nip portion width) of the belt with the heating roller is changed, a period of time to heat, fuse and compress a toner layer is changed. In the above system, in the same manner as that of the method disclosed in Japanese Unexamined Patent Publication No. 55-29822, an intensity of the pushing force of the belt to the heating roller is low. Therefore, it is impossible to sufficiently compress the toner layer. As a result, in the case of fusing a multi-color image, the masking of the lower toner layer conducted by the upper toner layer can not be removed, and the coloring property is deteriorated.

SUMMARY OF THE INVENTION

Accordingly, an object of the present invention is to provide a high speed fusing device in which the paper transport speed is stabilized, the recording medium does not slacken between the second and third rollers, and deterioration of the fusing/fixing performance due to the slackness is prevented, and the paper wrinkles and paper jams are not caused, irrespective of the thickness of paper, the surface conditions of the second and third rollers, for example, oil coating conditions, and roller temperature of the first to third rollers.

Further, it is another object of the present invention to provide an image forming apparatus having a compact fusing device, the processing speed of which is high, characterized in that: the coloring property is high when a multi-color image is formed; the transparence is high when a multi-color image is formed on a transparent sheet; the glossiness of a fused image can be arbitrarily changed in accordance with the preference of a user in a wide range from the high glossiness to the low glossiness; and jam clearance can be carried out easily.

According to the present invention, there is provided a fusing device for fusing a toner image onto a recording medium, comprising: a first roller for heating a recording medium; a second roller pressed against the first roller to form a first nip portion therebetween; and a third roller pressed against the first roller to form a second nip portion therebetween, the recording medium passing through the first and second nip portions; wherein the first and third rollers are forcibly driven so that a peripheral speed of the third roller is higher than of the first roller.

Further, according to the present invention, there is provided a fusing deive for fusing a toner image onto a recording medium, comprising: a heating member; pressurizing members pressed against the heating member to form a plurality of nip portions therebetween; and change-over means for changing over the number of the nip portions through which the recording medium passes.

Still further, according to the present invention, there is provided an image forming apparatus comprising: a heating roller for heating a recording medium; a first pressurizing roller pressed against the heating roller to form a first nip portion therebetween; a second pressurizing roller pressed against the heating roller to form a second nip portion therebetween; and change-over means being disposed between the first and pressurizing rollers in a recording medium path, and changing over the number of the nip portions through which the recording medium passes; wherein the heating and second pressurizing rollers are forcibly driven so that a peripheral speed of the second pressurizing roller is higher than of the heating roller.

DETAILED DESCRIPTION OF THE PREFERRED EMBODIMENTS

Figure 1:
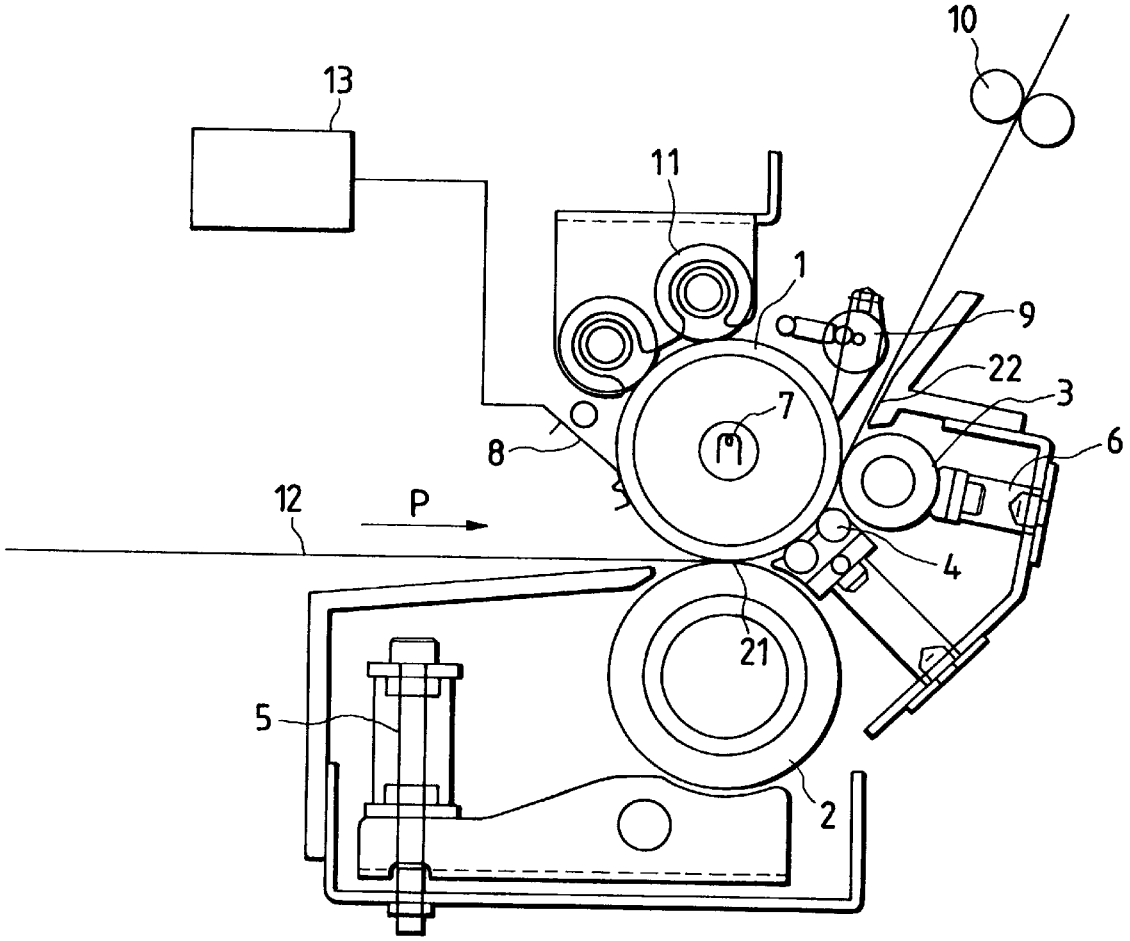
FIG. 1 is a sectional view schematically showing a fusing device embodying the present invention in a mode.

The preferred embodiments of the present invention will be described with reference to the accompanying drawings.

First of all, the image forming apparatus will be briefly explained as follows.

In the image forming apparatus, a charging means such as a charging roller electrically charges an electrostatic latent image holding body such a photosensitive body to a certain uniform voltage (for example, −700 V). An electrostatic latent image is formed on the electrostatic latent image holding means by laser beams, the resolution of which is 600 dpi (dot per inch), formed by an exposure means such as a laser beam scanning optical system. Image information generated by a host computer or color mode information, which expresses whether mono-color or multi-color, designated by a color designation switch arranged on the image forming apparatus, is sent to CPU arranged in the image forming apparatus. In accordance with a predetermined sequence, an image forming control means makes a yellow developing unit, which is one of the one component contact type developing units, come into contact with the electrostatic latent image holding body, and the image forming control means makes other developing units separate from the electrostatic latent image holding body, so that the negatively charged yellow toner is subjected to reversal development by the action of an electric filed. In this way, the latent image is made to be visual on the electrostatic latent image holding body. The thus visualized yellow toner image is put in an electric field, the polarity of which is reverse to that of toner, in the first transfer section composed of an intermediate transfer body and a primary transfer roller, so that the visualized yellow toner image can be transferred onto the intermediate transfer body.

In the same manner as described above, magenta toner, cyan toner and black toner are successively superimposed on the intermediate transfer body, so that a full color image can be formed. The thus formed full color image on the intermediate transfer body is introduced into a secondary transfer section and transferred onto a recording sheet by the action of an electric field. The recording sheet on which the unfused toner image is formed is heated and fused by a fusing device and ejected outside the image forming apparatus via a sheet ejecting passage.

Next, a sheet feeding and conveying method will be described below. The image forming apparatus has a plurality of sheet feeding means such as sheet feed cassettes. In the sheet feed cassettes, recording sheets of different sizes are accommodated. Transparent sheets used for an overhead projector (OHP) are accommodated in one sheet feeding means. Bond sheets are accommodated in another sheet feeding means. Envelopes are accommodated in still another sheet feeding means. In each sheet feeding means, there is provided a sheet size detecting means for detecting the size of recording sheets. By this sheet size detecting means, the size of sheets of A3 or A4 or the size of envelopes is detected and outputted to CPU arranged in the image forming apparatus, and this sheet size is used as information of the recording sheet size. In accordance with the size information of a recording sheet sent from the host computer, or alternatively in accordance with the size information of a recording sheet designated by a recording sheet size designating switch arranged on the image forming apparatus, the control means of the image forming apparatus selectively drives the sheet feeding means, so that a recording sheet of a predetermined size can be fed into the recording sheet conveying passage. At a position immediately close to the sheet feeding means, there is provided a material detecting means for detecting the material of the recording sheet. By this material detecting means, the type of the recording sheet is detected. The thus obtained material information of the recording sheet is outputted to CPU arranged in the image forming apparatus. For example, the material detecting means is composed of a photo-coupler, by which the type of a recording sheet is judged in accordance with the transmission of light. By this material detecting means, it can be judged whether the recording sheet is a sheet of paper or a transparent sheet. Further, there are provided a light emitting element and a light receiving element, and a predetermined quantity of light is emitted to a recording sheet and a quantity of reflected light or a quantity of diffused light is detected by the light receiving element. By the light emitting and the light receiving element, it can be judged whether the recording sheet is a sheet of smooth paper or a sheet of rough paper. In this connection, information sent from the host computer, or information designated by the material designating switch arranged on the image forming apparatus may be used as the material information. On the other hand, information sent from the host computer, or information designated by the glossiness designating switch arranged on the image forming apparatus is used as the glossiness information and outputted to CPU. As described above, the size information of a recording sheet, material information, glossiness information and color mode information are prepared in the image forming apparatus.

Next, the construction of an embodiment of the fusing device according to the present invention will be described with reference to accompanying drawings.

FIG. 1 is a view schematically showing a fusing device embodying the present invention in a mode. As shown, the fusing device is formed with a first roller 1, a second roller 2, and a third roller 3. The first roller 1 is a heating roller (heating member) constructed such that a rubber layer is layered on the circumferential outer surface of a cylindrical member made of a metal of good thermal conductivity, e.g., aluminum. The second roller 2 is a pressurizing roller (pressurizing member) constructed such that a thick layer of an elastic material, e.g., silicon rubber, is formed on the circumferential outer surface of a metal shaft. The third roller 3 is a pressurizing roller (pressurizing member) constructed such that a stripping layer is formed on a metal cylindrical member.

A heating member 7, for example, a halogen lamp, is disposed within the first roller 1. A layer of fluororubber, such as HTV, RTV, or LTV, is formed on the metal cylindrical member in order to secure its good contact with a recording medium or a recording sheet 12 of paper. To provide an easy release of toner particles from the rubber layer, a toner releasing layer, made of pure silicone, PFA, or PTFE, may be formed on the rubber layer by coating or in the form of a tube.

Since a surface roughness of the first roller 1 affects a transparency of a toner image on a transparent sheet, it is preferably 1 $\mu$mRa or smaller (center line average roughness prescribed by JIS B0601). A thermal sensing element 8, for example, a thermistor, is located on or near the outer surface of the first roller 1. A signal derived from the thermal sensing element 8 is applied to a temperature control means 13 which in turn controls current fed to the heating member 7 to set temperature of the heating member at a desired temperature.

The second roller is constructed such that a layer of silicone rubber, such as HTV, RTV, or LTV, or fluororubber, is formed on the outer surface of a steel shaft or a steel cylindrical member by injection molding. If required, a toner releasing layer, made of pure silicone, PFA or PTFE, may be formed on the rubber layer by coating or in the form of a tube.

Additionally, to improve the releasability of toner, the rubber layer may be impregnated with a releasing agent, for example, silicone oil. The thickness of the second roller is preferably 5 mm or less to obtain a quick warming up.

The third roller is constructed such that a layer of silicone rubber, such as HTV, RTV, or LTV, or fluororubber, is formed on the outer surface of a steel shaft or a steel cylindrical member by injecting molding. If required, a toner releasing layer, made of pure silicone, PFA or PTFE, may be formed on the rubber layer by coating or in the form of a tube.

Additionally, to improve the releasability of toner, the rubber layer may be impregnated with a releasing agent, for example, silicone oil. The third roller may also be constructed such that a releasing layer may be formed on the outer surface of a steel shaft or a steel cylindrical member by coating the outer surface thereof with pure silicone, PFA or PTFE or covering the same with a tube made of the same material.

When the surface of the first roller 1 is formed of deformable rubber, for example, RTV, the surface of the third roller 3 is formed of a material relatively hard to be deformed (e.g., rubber harder than the rubber of the surface layer of the first roller), and the diameter of the third roller 3 is shorter than 20 mm, a second nip portion 22 is curved outward to the third roller 3. It has a curvature stripping function, so that there is no need of using a stripping pawl. Where no stripping pawl is used, there is no danger that the first roller 1 is abraded or damaged with the stripping pawl. Further, its offset performance is little deteriorated and the number of fusing operations within which the fusing device can exercise its normal fusing function. When the second nip portion 22 is curved outward to the third roller 3, a curling tendency of the sheet is lessened. There is no need of using a decurler, and eliminated a deterioration of the picture quality, which results from the abrasion of the image surface with the decurling member. Because of the configuration of the second nip portion 22 curved outward to the third roller 3, a surface hardness of the third roller. 3 is preferably higher than of the first roller 1, more exactly higher than 40 degree of JIS-A hardness.

In the arrangement of the first to third rollers, a first pressurizing means 5 operates so that the second roller 2 and the first roller 1 are pressed against each other, to thereby form a first nip portion 21. A second pressurizing means 6 operates so that the third roller 3 and the first roller 1 are pressed against each other, to thereby form the second nip portion 22. The first and second pressurizing means 5 and 6 may be constructed with coiled springs or plate springs.

The leading or trailing end of the recording sheet tends to separate from the first roller 1 in a location between the second and third rollers 2 and 3. If the sheet separates from the roller, a color irregularity possibly occurs in particular when the sheet is thick. If a guide 4 is provided between the second and third rollers 2 and 3 while partly contacting the first roller 1, then the guide prevents the leading or trailing end of the sheet from separating from the first roller and hence the color irregularity is not caused. The guide may be a metal roller of 5 mm in diameter.

The fusing device, if necessary, may be equipped with a stripping pawl 9 for stripping the recording sheet 12 from the first roller 1, a paper discharging roller 10 for smoothly discharging outside the paper, which emanates from the second nip portion 22, an oil coating member 11 for applying a releasing agent, for example, silicone oil, onto the surface of the first roller 1 for its coating, a cleaner, for example, an oil contained pad, for removing toner attached to the surface of the roller, and the like. The recording sheet 12 of paper may be thin plain paper, thick paper, such plain paper as a post card or a transparent sheet used for OHP.

The first roller is driven to turn by a drive mechanism to be given later, the second roller is turned by a friction in the first nip portion 21, the third roller is driven to turn by a drive mechanism to be given layer, the recording sheet 12 is moved in the direction of arrow P to enter the first nip portion 21, a loose powder toner image is fused to a medium state, and then the recording sheet 12 is moved to enter the second nip portion 22 where it is heated, fused, and permanently fixed on the recording sheet. The second roller may be driven by a drive device to be given later.

If the first and second rollers 1 and 3 are forcibly driven so that the peripheral speed of the third roller 3 is higher than of the first roller 1, the following advantages will result irrespective of the thickness of paper, the surface conditions of the second and third rollers 2 and 3, for example, oil coating conditions, and roller temperature of the first to third rollers 1 to 3. The advantages are: the paper transport speed is stabilized, the recording medium does not slacken between the second and third rollers 2 and 3, and deterioration of the fusing/fixing performance due to the slackness is prevented, and the paper wrinkles and paper jams are not caused.

Specifically, if the peripheral speeds V1 and V3 of the first and third rollers are selected so as to satisfy the following condition $$V1<V3\leqq 1.05\times V1 \quad (1)$$

the following advantages results. The paper transporting speed is stabilized. In addition, when those rollers are driven in a state that no paper is present between them, the surfaces of the first and third rollers are a little shifted to each other. The durability of the rollers is improved since an unwanted distortion of the surface members is not caused. The number of the fusing operations of the fusing device within which the fusing device can exercise its normal fusing function is increased.

Where the recording sheet is thick and large in size (the width thereof is large), the roller arrangement in which only the first and third rollers are forcibly driven operates such that the second roller 2 slips or cannot produce a braking force. In this case, by forcibly driving the second roller 2, the braking force thereof is effective. Therefore, the freedom of a choice of the surface materials and surface roughness, and the amount of oil coating is increased, and an easy maintenance and an improved machine durability are secured.

At this time, if the first and second rollers V1 and V2 are forcibly driven under the following conditions $$0.95\times V1\leqq V2\leqq V1 \quad (2)$$

the following advantages results. The paper transporting speed is stabilized. In addition, when those rollers are driven with no paper being present between them, the surfaces of the first and second rollers are a little shifted to each other. The durability of the rollers is improved since an unwanted distortion of the surface members is not caused. The number of the fusing operations of the fusing device within which the fusing device can exercise its normal fusing functions is increased.

A deformation of the roller surface also varies a speed of the outer peripheral surface of the roller. In case where one of the paired rollers being pressed against with each other is hard, while the other is soft, the peripheral speeds of the rollers differ in the nip portion therebetween. When the speed difference is too large, the toner image is disarranged. To avoid this, a distance Rn from the roller center of the soft roller to the outer peripheral surface of the roller within the nip portion and a distance Ro from the roller center to the peripheral surface out of the nip portion are preferably selected to be within the range defined as given below $$0.98\times Ro<Rn\leqq Ro \quad (3)$$

The roller fusing device is suitable for a high speed printing since a wide nip width is secured. The fusing device of the present invention is useful in particular when the peripheral speed of the first roller 1 is 900 mm/sec to 200 mm/sec.

Mutual relationships of frictional forces among the rollers will now be described.

A case is given where a drive source forcibly drives the first roller 1 and the third roller 3 by use of a drive mechanism, the peripheral speed of the third roller is set to be higher than of the first roller, the recording sheet is simultaneously nipped in the first nip portion 21 and the second nip portion 22, and the paper is slackened between the first nip portion 21 and the second nip portion 22. To eliminate the slack of the paper, the following condition must be continued till the slack is removed: The recording sheet 12 slips on the surface of the first roller 1 in the second nip portion 22, and the recording sheet 12 does not slip on the surface of the third roller 3 in the same nip portion. In a state that the slack is removed and the recording sheet 12 is stretched between the first nip portion 21 and the second nip portion 22, it is necessary that the recording sheet 12 does not slip on the surface of the first roller 1 in the first nip portion 21, and recording sheet 12 also does not slip on the surface of the first roller 1 in the second nip portion 22, and the recording sheet 12 slips on the surface of the third roller 3.

It is assumed that a frictional force (=coefficient of friction×total load) between the surface of the first roller 1 and the recording sheet 12 in the first nip portion 21 is M1, a frictional force between the surface of the first roller 1 and the recording sheet 12 in the second nip portion 22 is M1', a frictional force between the surface of the third roller 3 and the recording sheet 12 in the second nip portion 22 is M3.

A frictional force relationship between them before the slack is removed can mathematically be given by an expression (4).

$$M3>M1' \tag{4}$$

A frictional force relationship between them after the slack is removed can mathematically be given by an expression (5).

$$M1+M1'>M3 \tag{5}$$

Combining the expressions (4) and (5), we have $$M1+M1'>M3>M1' \tag{6}$$

By satisfying the above expression, when the paper is slackened, the slack of the paper can be removed, and when the paper is not slackened, no agitation of the toner image takes place.

It is assumed that a coefficient of friction between the surface of the first roller 1 and the recording sheet 12 in the first nip portion 21 is $\mu 1$, a coefficient of friction between the surface of the first roller 1 and the recording sheet 12 in the second nip portion 22 is $\mu 1'$, a coefficient of friction between the surface of the third roller 3 and the recording sheet 12 in the second nip portion 22 is $\mu 3$, a total load applied by the first pressurizing means 5 is F1, and a total load applied by the second pressurizing means 6 is F2. A frictional force is give by $$\text{Frictional force}=\text{coefficient of friction}+\text{total load} \tag{7}$$

Thence, the expression (5) can also be expressed by an expression (8).

$$\mu 1\times F1+\mu 1'\times F2>\mu 3\times F2 \tag{8}$$

Rearranging the expression (8), we have $$\mu 1\times F1/F2>\mu 3-\mu 1' \tag{9}$$

If F2<F1, the left side of the expression (9) becomes large, and a range to which the coefficients of friction $\mu 1$, $\mu 1'$ and $\mu 3$ are applicable is enlarged. This fact implies that much freedom of a choice of the surface materials, oil coating conditions, kinds of oils, and viscosities of oil is gained.

In the first nip portion 21, a large total load is required for securing a large frictional force in order to secure the fusing/fixing performance and the fuser roll nip width and prevent the toner image from being disarranged. A more preferable total load for the fusing device of the invention ranges from 10 kgf to 130 kgf (for the width of A3). In the second nip portion 22, a medium frictional force is required such that when the heated object is loosened, it does not slip on the fuser roller, and when it is tightened, it slips on the fuser roller. For this reason, the frictional force required for the second nip portion 22 is smaller than for the first nip portion 21. In the fusing device of the invention, the total load is preferably within 400 gf to 14 kgf (A3 width).

Next, a fuser roller driving method will be described.

Figure 2:
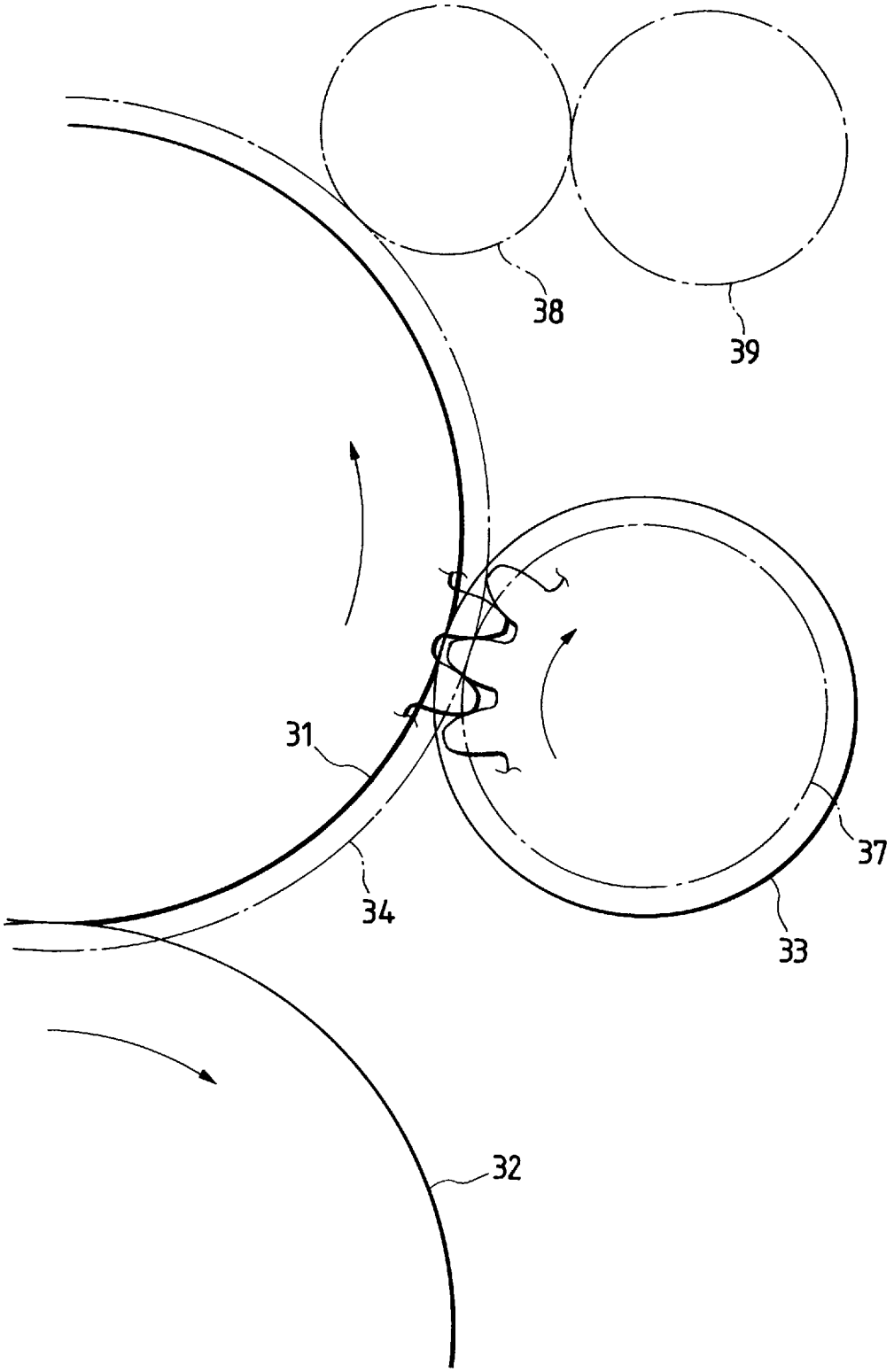
FIG. 2 is a diagram useful in explaining a forcible roller driving method for forcibly driving first and second rollers in the ing device of FIG. 1.

FIG. 2 is a diagram useful in explaining an example of a roll driving method for forcibly driving the first roller 1 and the third roller 3. A first roller peripheral surface 31 is in contact with a second roller peripheral surface 32 and a third roller peripheral surface 33. The gear having a pitch circle 34, which is coaxial with the first roller 1 and fixed to the same, is driven by the gear having a pitch circle 39 which is directly coupled with a motor, through a drive/transfer gear having a pitch circle. The third roller 3 is provided with a gear having a pitch circle 37, which is coaxial with the third roller per se. The gear having the pitch circle 37 is in contact with the gear having the pitch circle 34 of the first roller, and driven by the latter.

A specific example of the fuser roller arrangement exercising the forcible roller driving method follows. The diameter of the first roller peripheral surface 31 is 40 mm. The number of teeth of the gear having the pitch circle 34 is 81 (module: 0.5). The diameter of the third roller peripheral surface 33 is 15 mm, and the number of teeth thereof is 29 (module: 0.5). In this example, when the first and third rollers are forcibly driven, the third roller peripheral surface 33 is 5% faster than the first roller peripheral surface 31 in their movement.

If the peripheral speeds V1 and V3 of the first and third rollers satisfy the following condition $$V1<V3<1.05\times V1 \tag{10}$$

the following advantages will result. When those rollers are driven with no paper being present therebetween, the relative surface shift of the first and third rollers is little created. The durability of the rollers is improved since an unwanted distortion of the surface members is not caused. The number of the fusing operations of the fusing device within which the fusing device can exercise its normal fusing functions is increased.

An example of the forcible driving method where the first and third rollers are forcibly driven and the second roller is also forcibly driven, will be described hereunder.

Figure 3:
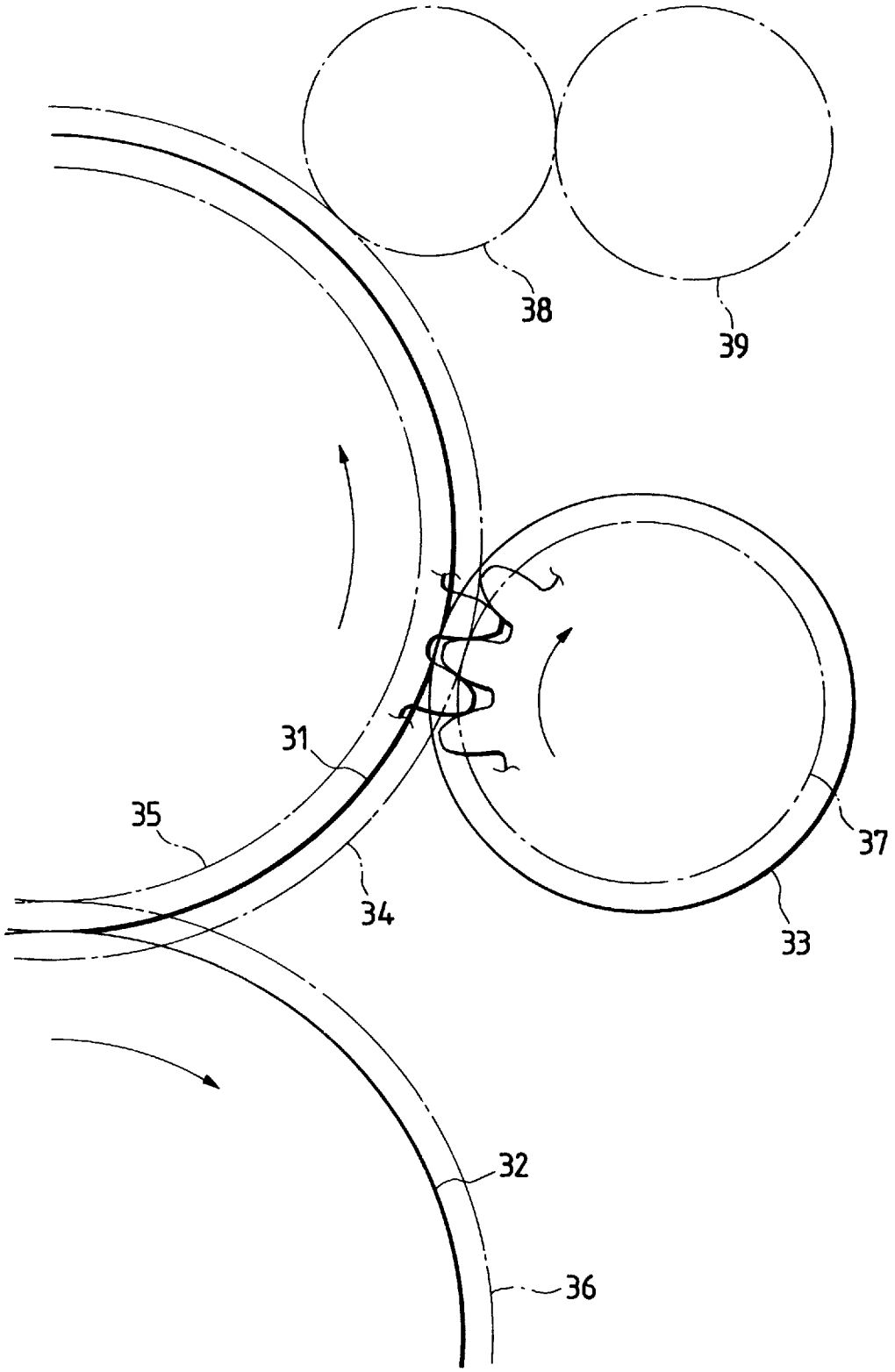
FIG. 3 is a diagram useful in explaining another forcible roller driving method for forcibly driving first to third rollers in the fusing device of FIG. 1.

FIG. 3 is a diagram useful in explaining another forcible roller driving method for forcibly driving first to third rollers in the fusing device. In the roller arrangement for this driving method, two gears are additionally used: one is a gear having a pitch circle 35, attached to the first roller, and the other is a gear having a pitch circle 36, attached to the second roller. These gears are coaxial with the first and second rollers, respectively. The gear having the pitch circle 36 is driven by the gear having the pitch circle 35. The remaining construction of the roller arrangement is substantially the same as of the FIG. 2 roller arrangement.

A specific example of the roller arrangement is given. The diameter of the second roller peripheral surface 32 is 40 mm. The number of teeth of the gear having the pitch circle 35, attached to the first roller, is 78 (module: 0.5). The diameter of the second roller peripheral surface 32 is 40 mm, and the number of teeth thereof is 82 (module : 0.5). In the example, when these rollers are forcibly driven, the second roller peripheral surface 32 is 5% slower than the first roller peripheral surface 31 in their movement.

Since the first and second rollers V1 and V2 are forcibly driven under the following conditions $$0.95 \times V1 \leqq V2 \leqq V1 \quad (11)$$

the following advantages results. When those rollers are driven with no paper being present between them, the surfaces of the first and second rollers are a little shifted to each other. The durability of the rollers is improved since an unwanted distortion of the surface members is not caused. The number of the fusing operations of the fusing device within which the fusing device can exercise its normal fusing functions is increased.

While the present invention has been described in detail, it should be understood that the present invention is not limited to the above-mentioned embodiments. A belt or chain and a sprocket, as well as the gears, may be used for transferring the forcible drive forces. While the drive force is transferred from the first roller 1 to the third roller 3 in the above-mentioned embodiment, it may be transferred to the first roller and the third roller by way of gears. In this case, the module of the gear directly driving each roller may be increased. It may withstand high load torque for driving the fusing device, and hence high durability thereof is secured.

The thickness of a sheet of paper is 70 to 100 $\mu$m. In the case of the post card, a thin post card is 150 $\mu$m and a thick one is 250 $\mu$m. The first to third rollers are different in the thickness and hardness of the rubber layers, and no rubber layer is not used by some of them. When the recording sheets having different thicknesses are nipped at the first and second nip portions, the quantities of deformation of the rubber layers are different. This leads to the transport speed difference. When comparing a sheet of paper and an envelope, the thicknesses of them are greatly different. At the equal roller angular speed, the transport speed of the envelope is slower than of the paper. If the transport speed by the third roller 3 when the envelope is transported is slower than when a sheet of paper is transported, the envelope can effectively be prevented from being broken. Therefore, for the effective envelope breakage prevention, the third roller 3 is turned faster or the second roller 2 is turned slower when only the envelope is transported.

A possible means to vary the drive speed of the third roller 3 when only the envelope is to drive the first and third rollers by separate motors and to vary the peripheral speed of the third roller by a speed controller, or to use an electromagnetic clutch located in the drive force transfer path to the third roller and to vary the roller speed by using the clutch. The same means may correspondingly applied to the second roller 2 for the same purpose.

Figure 4:
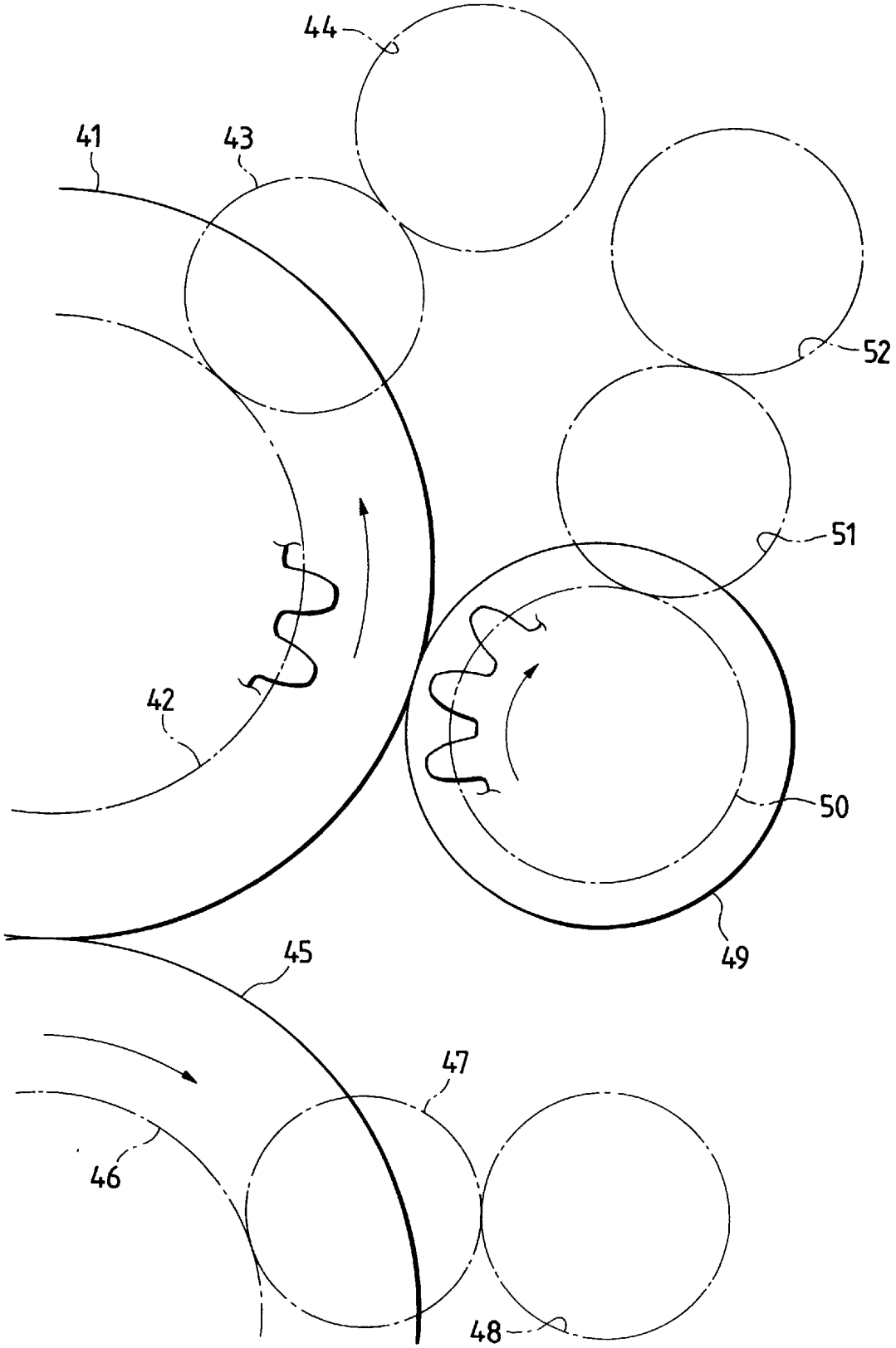
FIG. 4 is a diagram useful in explaining an additional driving method in which the first to third rollers are separately driven.

FIG. 4 is a diagram useful in explaining an additional driving method in which the first to third rollers are separately driven. In the figure, gears are represented by pitch circles. A gear 42 is fixed to the first roller 41, and the gear 42 is driven by a gear 44 fixed to a motor A through a gear 43. A gear 46 is fixed to the second roller 45, and a gear 46 is driven by a gear 48 fixed to a motor B through a gear 47. A gear 50 is fixed to the third roller 49, and a gear 50 is driven by a gear 53 fixed to a motor C, through a gear 51.

If so arranged, an optimum speed not causing winkles of the paper may be set up in accordance with the thickness and kind of paper used.

Next, the construction of another embodiment of the fusing device according to the present invention will be described with reference to FIGS. 5 to 7.

Figure 5:
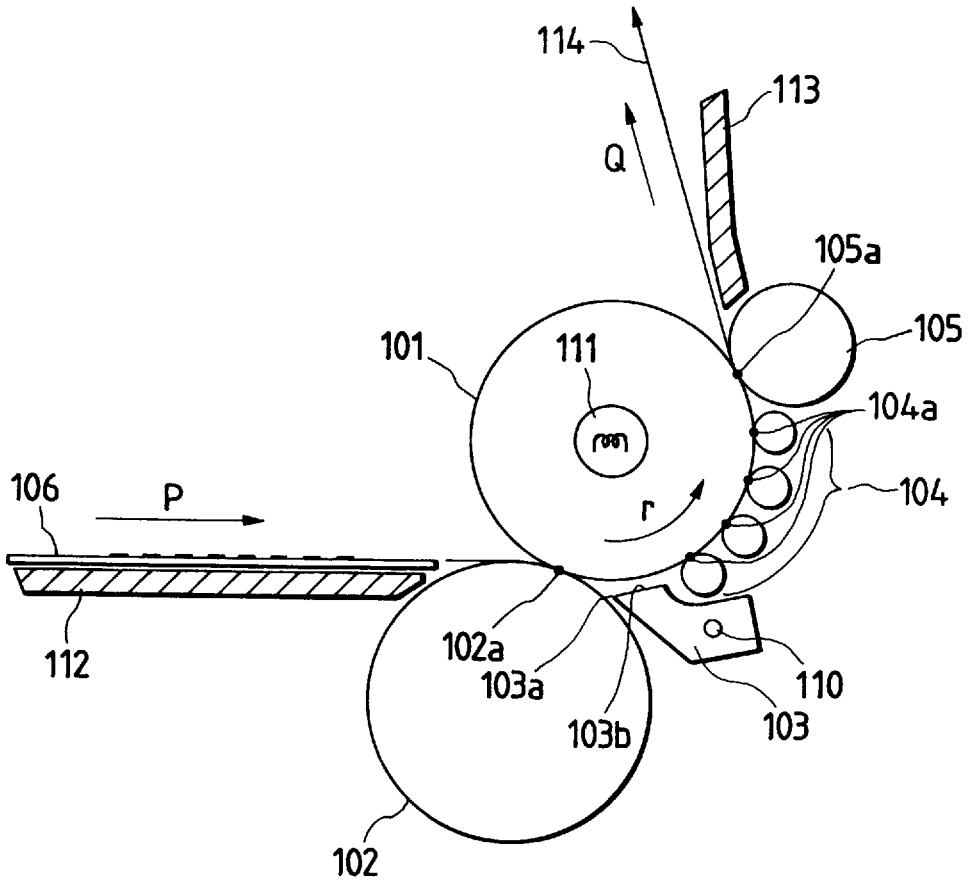
FIG. 5 is a schematic illustration showing another embodiment of the arrangement of the fusing device of the image forming apparatus of the present invention.

FIG. 5 is a schematic illustration showing an arrangement of the fusing device of the image forming apparatus of the present invention.

Concerning the fusing device, there is provided a heating roller 101 which is a heating member having a heating means 111 such as a halogen lamp. The heating roller 101 is pivotally supported so that it can be rotated in the direction of arrow r in the drawing. On the outer circumference of the heating roller 101, there are provided a first pressurizing member, a first change-over means and a second pressurizing member which are arranged in order in the rotational direction (arrow r in the drawing) of the heating roller 101. In this case, the first pressurizing member is composed of a first pressurizing roller 102, and the first change-over means is composed of a movable guide 103. The second pressurizing member is composed of a plurality of rollers, that is, the second pressurizing member is composed of a group of the second pressurizing rollers 104 and a third pressurizing roller 105.

The first pressurizing roller 102 of the first pressurizing member, the second pressurizing roller group 104 of the second pressurizing member, and the third pressurizing roller 105 are pushed against the heating roller 101 by a well known pressurizing means such as a spring. Accordingly, there are respectively formed a first nip portion 102*a*, a second nip portion group 104*a* composed of a plurality of nip portions, and a third nip portion 105*a*. The movable guide 103 of the first change-over means is pivotally mounted round a fulcrum 110. Therefore, the movable guide 103 of the first change-over means can be set at two positions. One is a first position at which a fore end 103*a* of the movable guide 103 is separate from the outer circumferential surface of the heating roller 101, and the other is a second position at which the fore end 103*a* of the movable guide 103 is set at a position close to the outer circumferential surface of the heating roller 101, or the fore end 3*a* of the movable guide 103 comes into contact with the outer circumferential surface of the heating roller 101. In FIG. 5, the movable guide 103 is set at the first position. The second pressurizing roller group 104 act as a second change-over means, which will be described later. The second pressurizing roller group 104 can be selectively set at two positions. One is a first position at which the second pressurizing roller group 104 come into contact with the outer circumference of the heating roller 101, and the other is a second position at which the second pressurizing roller group 104 are separate from the outer circumference of the heating roller 101. In FIG. 5, the second pressurizing roller group 104 are set at the first position. In the front of the first nip portion 102*a*, there is provided a sheet guide 112 for guiding a recording sheet before fusing, and at the rear of the third nip portion 105*a*, there is provided a sheet guide 113 for guiding a recording sheet after fusing.

A recording sheet 106 having a toner image, which has not been fused yet, is guided by the sheet guide 112 for guiding a recording sheet before fusing, and moved in the direction of arrow P shown in the drawing. In this way, the recording sheet 106 is guided to the first nip portion 102*a*. Next, since the movable guide 103 is set at the first position at which the fore end 103*a* of the movable guide 103 is located at a position separate from the outer circumferential surface of the heating roller 101, the recording sheet 106 passes through between the guide surface 103*b* of the movable guide 103 and the heating roller 101, and guided to the second nip portion group 104*a* and the third nip portion 105*a*. After the recording sheet 106 has passed through the second nip portion group 104*a* and the third nip portion 105*a*, it is guided by the recording sheet guide 113 for guiding a recording sheet after fusing and ejected in the direction of arrow Q shown in the drawing. As described above, the recording sheet 106 passes in a passage via the nip portions 102*a*, 104*a*, 105*a*, and this passage is defined as a first conveyance passage 114. When the recording sheet 106 passes in the first conveyance passage 114, it passes through the largest number of nip portions. Therefore, the period of time to heat, fuse and compress a toner layer becomes the longest.

Figure 6:
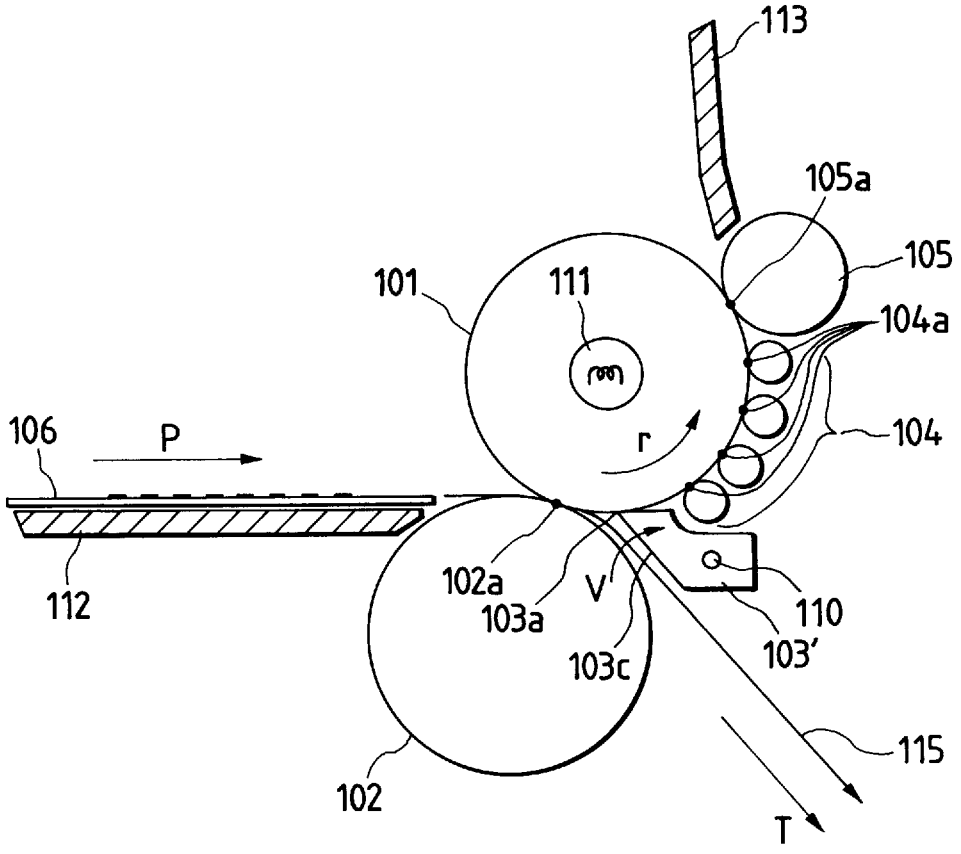
FIG. 6 is a schematic illustration showing an example of the operation of the fusing device of the image forming apparatus of the present invention.

FIG. 6 is a schematic illustration showing an operation of an example of the fusing device of the image forming apparatus of the present invention.

The arrangement shown in FIG. 6 is different from the arrangement shown in FIG. 5 as follows. The movable guide 103 of the first change-over means is rotated round the fulcrum 110 in the direction of arrow V in the drawing, so that the fore end 103*a* of the movable guide 103 is set at a position close to the outer circumferential surface of the heating roller 101 or the fore end 103*a* of the movable guide 103 is contacted with the outer circumferential surface of the heating roller 101, that is, the movable guide 103 is set at the second position.

A recording sheet 106 having a toner image, which has not been fused yet, is guided by the sheet guide 112 for guiding a recording sheet before fusing, and moved in the direction of arrow P shown in the drawing. In this way, the recording sheet 106 is guided to the first nip portion 102*a*. Next, since the movable guide 103 is set at the second position at which the fore end 103*a* of the movable guide 103 is contacted with the outer circumferential surface of the heating roller 101, the recording sheet 106 is guided on a guide surface 103*c* of the movable guide 103 and ejected in the direction of arrow T in the drawing. As described above, the recording sheet 106 passes in a passage in which only the first nip portion 102*a* is arranged. This passage is defined as a second conveyance passage 115. When the recording sheet 106 passes in the second conveyance passage 115, it passes through only one nip portion. Therefore, the period of time to heat, fuse and compress a toner layer becomes the shortest. In this connection, other composing elements and operation are the same as those of the arrangement shown in FIG. 5.

Figure 7:
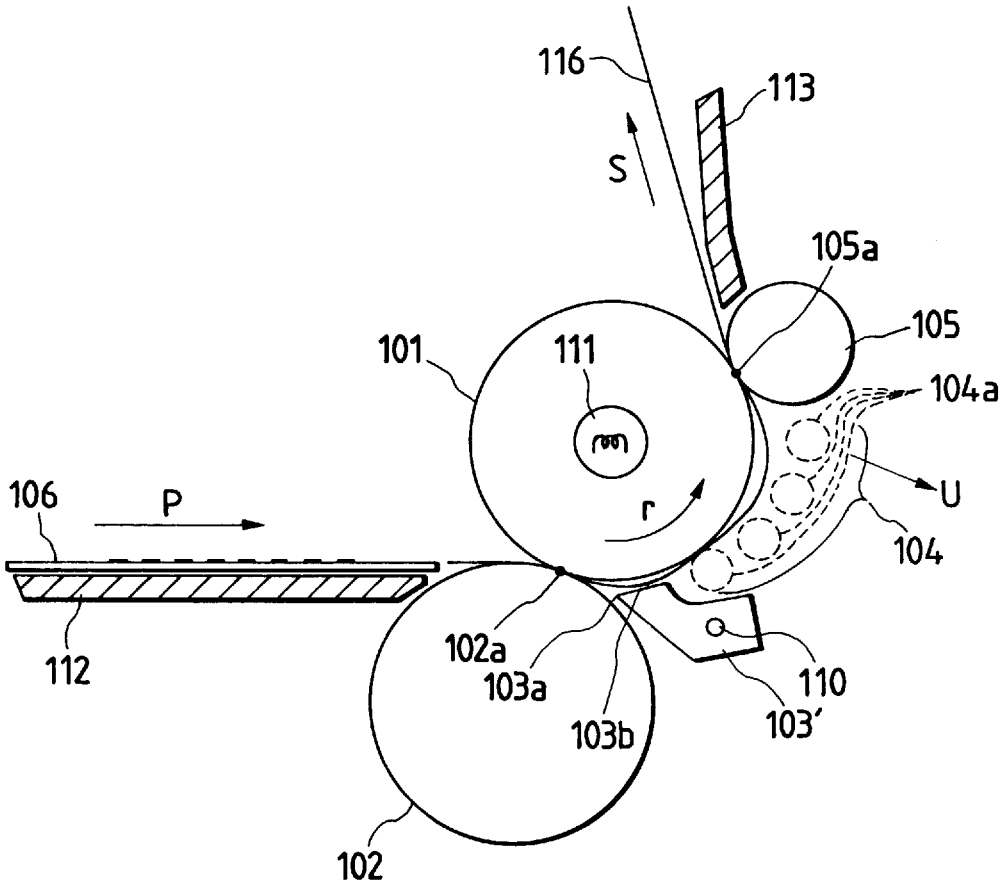
FIG. 7 is a schematic illustration showing another example of the operation of the fusing device of the image forming apparatus of the present invention.

FIG. 7 is a schematic illustration showing an operation of another example of the fusing device of the image forming apparatus of the present invention.

The arrangement shown in FIG. 7 is different from the arrangement shown in FIG. 5 as follows. The second pressurizing roller group 104 are moved in the direction of arrow U in the drawing in such a manner that they are separate from the outer circumference of the heating roller 101, that is, the second pressurizing roller group 104 are set at the second position. In this case, the second pressurizing roller group 104 act as a second change-over means.

A recording sheet 106 having a toner image, which has not been fused yet, is guided by the sheet guide 112 for guiding a recording sheet before fusing, and moved in the direction of arrow P shown in the drawing. In this way, the recording sheet 106 is guided to the first nip portion 102*a*. Next, since the movable guide 103 is set at the first position at which the fore end 103*a* of the movable guide 103, which is the first change-over means, is separate from the outer circumferential surface of the heating roller 101, the recording sheet 106 is guided between the guide surface 103*b* of the movable guide 103 and the heating roller 101. In this way, the recording sheet 106 is guided into a space formed between the second pressurizing roller group 104 and the heating roller 101. Then the recording sheet 106 is made to pass through the third nip portion 105*a* and guided by the sheet guide 113 for guiding a recording sheet after fusing and ejected in the direction of arrow S in the drawing. As described above, the recording sheet 106 is conveyed in a passage via the nip portions 102*a*, 105*a*, and this passage is defined as a third conveyance passage 116. When the recording sheet 106 passes in the third conveyance passage 116, it passes through two nip portions. Therefore, the period of time to heat, fuse and compress a toner layer becomes shorter than that of the first conveyance passage 114 and longer than that of the second conveyance passage 115 described before. In this connection, other composing elements and operation are the same as those of the arrangement shown in FIG. 5.

In order to selectively change over the arrangements shown in FIGS. 5, 6 and 7 in accordance with the circumstances, the movable guide 103, which is the first change-over means, and the second pressurizing roller group 104, which are the second change-over means, may be pivotally supported and selectively driven by a well known driving means such as a cam and clutch so that they can be respectively set at the first position or the second position.

As described above, when the first and the second change-over means arranged in the fusing device of the image forming apparatus of the present invention are respectively changed over between the first and the second position, it is possible to select one of the first 114, the second 115 and the third conveyance passage 116, so that the number of nip portions through which the recording sheet passes can be changed.

When a sheet of plain paper is used as the recording sheet 106 so as to fuse a multi-color image, the recording sheet 106 is made to pass through the third conveyance passage 116 so that the toner image can be fused, that is, the toner layer passes through two nip portions. Due to the foregoing, it is possible to heat, fuse and compress the toner layer so that the toner layer can be formed into a thin layer having no voids, without decreasing the fusing speed, and the masking of the lower toner layer conducted by the upper toner layer can be removed. Therefore, it was possible to obtain a multi-color image, the coloring property of which was high.

When a transparent sheet is used as the recording sheet 106 so as to fuse a multi-color image, the recording sheet 106 is made to pass through the first conveyance passage 114 so that the toner image can be fused, that is, the toner layer passes through a number of nip portions. Due to the foregoing, it is possible to heat, fuse and compress the toner layer so that the toner layer can be formed into a thin layer having no voids and no toner grain boundaries, without decreasing the fusing speed, and the toner layer surface can be formed into a mirror surface. Accordingly, it was possible to obtain a multi-color image, the transparence of which was high, on which light was seldom diffused.

Concerning the information to designate a recording sheet and an image to be formed, the following pieces of information are provided.

(1) Size information to express the size of a recording sheet such as A3, A4, envelope and postcard (2) Material information to express material of a recording sheet such as a transparent sheet, smooth paper, high grade paper and bond paper (3) Color mode information to express whether the printing on a recording sheet is of mono-color or multi-color (4) Glossiness information to express the glossiness of a recording sheet so as to determine whether a fused toner layer surface is made to be a mat surface of low glossiness or a gloss surface of high glossiness In accordance with each combination of the above items, the change-over means arranged in the fusing device of the image forming apparatus is changed over. The following are explanations of the combination of the above items to change over the change-over means for fusing a toner image. In this connection, there are a large number of combinations of the pieces of information of recording sheets and images. Accordingly, several examples of the combinations are shown on Table 1.

TABLE 1

| Example | Size | Material | Color mode Information | Designated glossiness information | First change-over means | Second change-over means | Conveyance passage |
|---|---|---|---|---|---|---|---|
| 1 | A4 | Transparent sheet | Multi-color | — | First position | First position | First Conveyance passage 114 |
| 2 | A3 | Smooth paper | Multi-color | — | First position | First position | First Conveyance passage 114 |
| 3 | A4 | Rough paper | Mono-color | — | Second position | First position | Second Conveyance passage 115 |
| 4 | Postcard Envelope | — | Mono-color | — | Second position | First position | Second Conveyance passage 115 |
| 5 | A4 | Common paper | Multi-color | — | First position | Second position | Third Conveyance passage 116 |
| 6 | A4 | Common paper | Multi-color | High glossiness | First position | First position | First Conveyance passage 114 |
| 7 | A4 | Common paper | Mono-color | Low glossiness | Second position | First position | Second Conveyance passage 115 |
| 8 | A3 | Smooth paper | Multi-color | Middle glossiness | First position | Second position | Third Conveyance passage 116 |

In the Table, mark—expresses that no restrictions are placed.

Examples 1 to 8 described on Table 1 will be explained as follows.

(1) Example 1

Example 1 is a case in which a transparent sheet of size A4 is used as the recording sheet 106, and a multi-color image is fused on the transparent sheet. Size information of A4 is inputted into CPU of the image forming apparatus, material information of transparent sheet is inputted into CPU of the image forming apparatus, and color mode information of multi-color is inputted into CPU of the image forming apparatus. According to a predetermined sequence, the control means is operated so that the first change-over means can be changed over to the first position and also the second changeover means can be changed over to the first position. Due to the above change-over operation, the first passage 114 can be formed. Accordingly, the recording sheet passes through a number of nip portions. Therefore, voids and toner grain boundaries can be removed from the inside of the toner layer, and the toner layer is heated, fused and compressed until the toner layer surface becomes a mirror surface. In this way, it was possible to obtain a fused multi-color image, the transparence of which was high, on which light was seldom diffused.

(2) Example 2

Example 2 is a case in which a sheet of smooth paper of size A3 is used as the recording sheet 106, and a multi-color image is fused on the sheet of smooth paper. Size information of A3 is inputted into CPU of the image forming apparatus, material information of smooth paper is inputted into CPU of the image forming apparatus, and color mode information of multi-color is inputted into CPU of the image forming apparatus. According to a predetermined sequence, the control means is operated so that the first change-over means can be changed over to the first position and also the second changeover means can be changed over to the first position. Due to the above change-over operation, the first passage 114 can be formed. Accordingly, the recording sheet passes through a number of nip portions. Therefore, the masking of the lower toner layer conducted by the upper toner layer can be removed, and the toner layer is heated, fused and compressed over a long period of time until the toner layer surface becomes a mirror surface. In this way, it was possible to obtain a fused multi-color image, the coloring property of which was high, and the surface of the fused multi-color image was highly glossy, wherein the glossiness was not lower than 40, so that a difference between the glossiness of the thus formed image and the glossiness of smooth paper on the background was small.

(3) Example 3

Example 3 is a case in which a sheet of rough paper of size A4 is used as the recording sheet 106, and a mono-color toner image is fused on the sheet of rough paper. Size information of A4 is inputted into CPU of the image forming apparatus, material information of rough paper is inputted into CPU of the image forming apparatus, and color mode information of mono-color is inputted into CPU of the image forming apparatus. According to a predetermined sequence, the control means is operated so that the first change-over means can be changed over to the second position and also the second change-over means can be changed over to the first position. Due to the above change-over operation, the second passage 115 can be formed. Accordingly, the recording sheet passes through only one nip portion. Therefore, heating, fusing and compressing of the toner layer is restricted to the minimum, and the toner layer contains a number of voids. In this way, it was possible to obtain a fused image, the toner layer surface of which was formed into a mat surface having irregularities, wherein the glossiness was not higher than 3, so that a difference between the glossiness of the thus formed image and the glossiness of rough paper on the background was small.

(4) Example 4

Example 4 is a case in which a postcard or envelope is used as the recording sheet 106, and a mono-color toner image is fused on the postcard or envelope. Color mode information of mono-color is inputted into CPU of the image forming apparatus. According to a predetermined sequence, the control means is operated so that the first change-over means can be changed over to the second position and also the second change-over means can be changed over to the first position. Due to the above change-over operation, the second passage 115 can be formed. Accordingly, the recording sheet passes through only one nip portion. Therefore, heating, fusing and compressing of the toner layer is restricted to the minimum, so that a quantity of heat given to the postcard or envelope can be reduced. Accordingly, it was possible to remove a curl of the postcard caused by thermal deformation. Also it was possible to remove wrinkles from the envelope.

(5) Example 5

Example 5 is a case in which a sheet of plain paper of size A4 is used as the recording sheet 106, and a multi-color toner image is fused on the sheet of plain paper. Size information of A4 is inputted into CPU of the image forming apparatus, material information of plain paper is inputted into CPU of the image forming apparatus, and color mode information of multi-color is inputted into CPU of the image forming apparatus. According to a predetermined sequence, the control means is operated so that the first change-over means can be changed over to the first position and also the second change-over means can be changed over to the second position. Due to the above change-over operation, the third passage 116 can be formed. Accordingly, the recording sheet passes through two nip portions. Therefore, the masking of the lower toner layer conducted by the upper toner layer can be removed, however, the toner layer contains a few voids and toner grain boundaries. Due to the foregoing, it was possible to obtain a fused multi-color image, the coloring property of which was high, of intermediate glossiness, and irregularities on the toner layer surface were small. In this case, the intermediate glossiness was approximately 10, and a difference of the intermediate glossiness of the toner layer and the glossiness of the plain paper on the background was small.

(6) Example 6

Example 6 is a case in which a sheet of plain paper of size A4 is used as the recording sheet 106, and a highly glossy multi-color toner image is fused on the sheet of plain paper. Size information of A4 is inputted into CPU of the image forming apparatus, material information of plain paper is inputted into CPU of the image forming apparatus, and color mode information of multi-color is inputted into CPU of the image forming apparatus. In addition to that, glossiness information of high glossiness, which is designated by a user through a glossiness designating switch arranged on the image forming apparatus, is inputted into CPU of the image forming apparatus. The third conveyance passage 116 is determined to be used, by the size information, material information and color mode information of the recording sheet, and the glossiness of the thus fused multi-color image is intermediate. However, priority is given to the designated glossiness information (high glossiness), so that the first conveyance passage 114 is selected. On the other hand, the control means changes over the first change-over means to the first position according to a predetermined sequence, and also the control means changes over the second change-over means to the first position, so that the first conveyance passage 114 can be formed. Accordingly, the recording sheet passes through a number of nip portions, and the masking of the lower toner layer conducted by the upper toner layer can be removed, and the toner layer is heated, fused and compressed over a long period of time until the toner layer surface becomes a mirror surface. In this way, it was possible to obtain a highly glossy fused multi-color image, the coloring property of which was high, and the glossiness of the fused image was not lower than 40, wherein the glossiness of the plain paper on the background was intermediate.

(7) Example 7

Example 7 is a case in which a sheet of plain paper of size A4 is used as the recording sheet 106, and a low glossy mono-color toner image is fused on the sheet of plain paper. Size information of A4 is inputted into CPU of the image forming apparatus, material information of plain paper is inputted into CPU of the image forming apparatus, and color mode information of mono-color is inputted into CPU of the image forming apparatus. In addition to that, glossiness information of low glossiness, which is designated by a user through a glossiness designating switch arranged on the image forming apparatus, is inputted into CPU of the image forming apparatus. The third conveyance passage 116 is determined to be used, by the size information, material information and color mode information of the recording sheet, and the glossiness of the thus fused mono-color image is intermediate. However, priority is given to the designated glossiness information (low glossiness), so that the second conveyance passage 115 is selected. On the other hand, the control means changes over the first change-over means to the second position according to a predetermined sequence, and also the control means changes over the second change-over means to the first position, so that the second conveyance passage 115 can be formed. Accordingly, the recording sheet passes through only one nip portion, and heating, fusing and compressing of the toner layer is restricted to the minimum, so that the toner layer contains a number of voids. In this way, it was possible to obtain a low glossy fused mono-color image, the toner layer surface of which was irregular, and the glossiness of the fused image was not higher than 3, wherein the glossiness of the plain sheet on the background was intermediate.

(8) Example 8

Example 8 is a case in which a sheet of smooth paper of size A3 is used as the recording sheet 106, and an intermediately glossy multi-color toner image is fused on the sheet of smooth paper. Size information of A4 is inputted into CPU of the image forming apparatus, material information of smooth paper is inputted into CPU of the image forming apparatus, and color mode information of multi-color is inputted into CPU of the image forming apparatus. In addition to that, glossiness information of intermediate glossiness, which is designated by a user through a glossiness designating switch arranged on the image forming apparatus, is inputted into CPU of the image forming apparatus. The first conveyance passage 114 is determined to be used, by the size information, material information and color mode information of the recording sheet, and the glossiness of the thus fused multi-color image is high. However, priority is given to the designated glossiness information (intermediate glossiness), so that the third conveyance passage 116 is selected. On the other hand, the control means changes over the first change-over means to the first position according to a predetermined sequence, and also the control means changes over the second change-over means to the second position, so that the third conveyance passage 116 can be formed. Accordingly, the recording sheet passes through two nip portions, and the masking of the lower toner layer conducted by the upper toner layer can be removed. However, the toner layer is heated, fused and compressed over a long period of time until the toner layer contains a few voids and toner grain boundaries. In this way, it was possible to obtain an intermediately glossy smooth fused multi-color image, the coloring property of which was high, and the glossiness of the fused image was approximately 110, wherein the glossiness of the smooth paper on the background was high.

As shown in Examples 1 to 8, with respect to at least one of size information, material information, color mode information and glossiness information, or alternatively, with respect to combinations of them, the change-over means provided in the fusing device arranged in the image forming apparatus is changed over. Due to the foregoing, the glossiness of a fused image can be changed in a range from the high glossiness to the low glossiness in accordance with the preference of a user as shown in Examples 2, 3, 5, 6, 7 and 8. Further, in the case of forming a multi-color image, the coloring property is high as shown in Examples 2, 5, 6 and 8. Furthermore, the transparence of a multi-color image formed on a transparent sheet can be enhanced as shown in Example 1.

Further, as shown in Example 4, it was possible to remove curls from a postcard and also remove wrinkles from an envelope.

Next, the operation of jam clearance to be conducted when the fusing device is jammed by a recording sheet will be explained below.

When a recording sheet 106 was fed by mistake into between the fore end 103*a* of the movable guide 103 and the heating roller 101 in the arrangement shown in FIG. 6, the movable guide 103 was rotated so that the fore end 103*a* of the movable guide 103 could be set at the first position shown in FIG. 5, and the recording sheet 106 caught between the fore end 103*a* of the movable guide 103 and the heating roller 101 was released and easily removed from the fusing device.

When a recording sheet 106 was blocked while it was passing through the second nip group 104*a* in the arrangement shown in FIG. 5, the second nip group 104*a* were moved to the second position shown in FIG. 7. Due to the foregoing operation, the recording sheet 106 caught by the second nip group 104*a* was released and easily removed from the fusing device.

When the fusing device was jammed by a recording sheet 106 which was fed by mistake into between the fore end 103*a* of the movable guide 103 and the heating roller 101 and arrived at the second nip group 104*a* in the arrangement shown in FIG. 6, the movable guide 103 was rotated so that the fore end 103*a* of the movable guide 103 could be set at the first position shown in FIG. 5, and also the second nip group 104*a* were moved to the second position shown in FIG. 7. Due to the foregoing operation, the recording sheet 106 caught by the fore end 103*a* of the movable guide 103 and the heating roller 101 and also caught by the second nip group 104*a* was released and easily removed from the fusing device.

As explained in the above three cases, even in the case of occurrence of jam in which a recording sheet is caught in the fusing device, the recording sheet can be easily removed from the fusing device by moving the change-over means.

In this connection, in the arrangement of the examples shown in FIGS. 5 to 7, the second pressurizing roller group 104 are changed over. However, the second pressurizing roller group 104 and the third pressurizing roller 105 may be simultaneously changed over. Alternatively, the second pressurizing roller group 104 and the third pressurizing roller 105 may be fixed, and the first pressurizing roller 102 may be changed over.

When the arrangement to fix the first pressurizing roller 102 is adopted, the following advantages can be provided. In the arrangement to fix the first pressurizing roller 102, it is possible to decrease a distance from the nip portion 102*a* between the heating roller 101 and the first pressurizing roller 102 to the fore end of the sheet guide 112 for guiding a recording sheet before fusing as compared to a case in which the first pressuring roller 102 is changed over. Accordingly, there is no possibility that an end of the recording sheet 106 collides with the heating roller 101 or the first pressurizing roller 102. Therefore, it is possible to stably insert the recording sheet 106 into the nip portion 102*a*. On the other hand, when the arrangement to change over the first pressurizing roller 102 is adopted, the following advantages can be provided. In the above arrangement, the first pressurizing roller also performs a function of changing over the passage of a recording sheet, which is originally a function to be performed by the movable guide 103. Therefore, it is possible to omit the movable guide 103. Accordingly, it is possible to avoid the occurrence of sheet jam. As a result, a ratio of occurrence of jam in the fusing device can be reduced.

Figure 8:
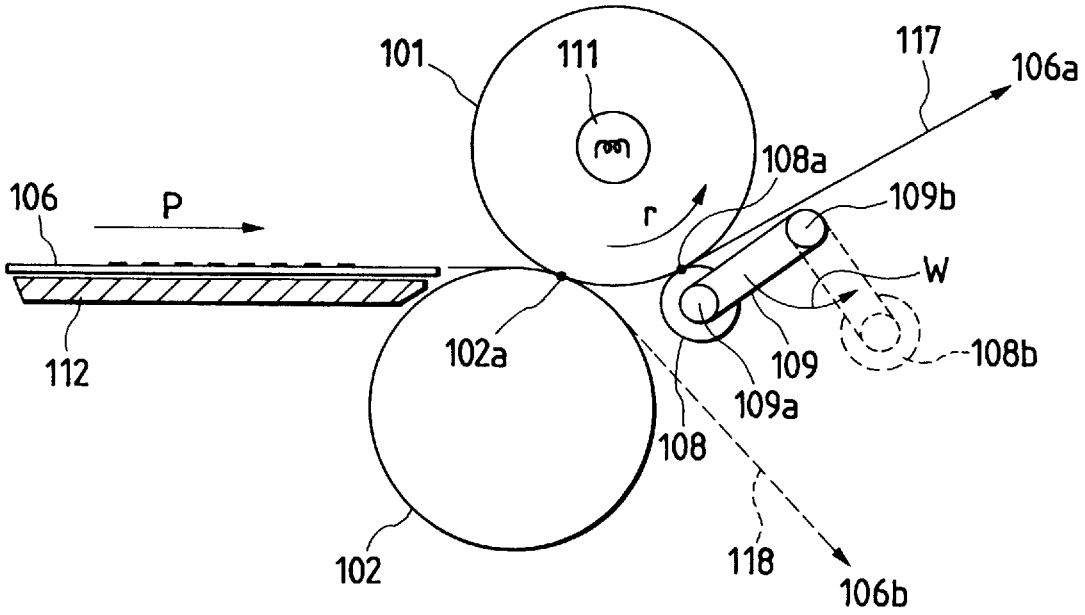
FIG. 8 is a schematic illustration showing another example of the arrangement and operation of the fusing device of the image forming apparatus of the present invention.

FIG. 8 is a schematic illustration showing an arrangement of another embodiment of the fusing device of the image forming apparatus of the present invention. In order to avoid duplicate explanations which were made in FIGS. 5 to 7, like reference characters are used to indicate like parts in FIGS. 5 to 8, and the explanations are omitted here.

The second pressurizing roller 108 is pivotally mounted on one end 9*a* of an attaching plate 109, and the other end of the attaching plate 109 is pivotally mounted on the fulcrum 109*b*. When the attaching plate 109 is pivotally pushed in the direction of the heating roller 101 by a well known pressurizing means such as a spring, the second pressurizing roller 108 is made to come into pressure contact with the heating roller 101. Therefore, the second pressurizing roller 108 can be changed over between the first position at which the nip portion 108*a* is formed and the second position at which the second pressurizing roller 108 is oscillated in the direction W in the drawing by the action of a well known spring or cam.

When the second pressurizing roller 108 is set at the first position, the recording sheet 106 conveyed in the direction of arrow P as illustrated in FIG. 8 passes through the nip portions 102*a*, 108*a* respectively formed by the first pressurizing roller 102 and the second pressurizing roller 108 and is introduced into a fore end portion 106*a*. This recording sheet conveyance passage is referred to as a first conveyance passage 117.

When the second pressurizing roller 108 is changed over to the second position, the second pressurizing roller 108 is rotated by a well known means in the direction of arrow W, that is, the second pressurizing roller 108 is moved to the position of the second pressurizing roller 108*b*. Under the above condition, the recording sheet 106 is conveyed in the direction of arrow P and passes through the first nip portion 102*a*. Then the recording sheet 106 is separated from the outer circumference of the heating roller 101 and introduced to the fore end portion 106*b*. This recording sheet conveyance passage is referred to as a second conveyance passage 118.

When the recording sheet 106 is conveyed in the first conveyance passage 117, it is pushed to the heating roller 101 at two nip portions and conveyed along the outer circumferential surface of the heating roller 102. Accordingly, a large quantity of heat is given to the recording sheet 106, and toner is completely fused and pressed. Therefore, toner is completely mixed with each other and formed into a thin film-shape having no grain boundaries, and the toner layer surface becomes smooth like a mirror surface. Accordingly, when the toner image was fused on a transparent sheet, it was possible to provide a high transparence property. When the toner image was fused on a sheet of smooth paper, it was possible to provide an image of high glossiness, and a difference between the glossiness of the recording sheet and the glossiness of the image was small. In order to form a highly glossy image on a sheet of rough paper from the viewpoint of improving the design property and also from the viewpoint of satisfying the preference of a user, an image was fused on a sheet of rough paper. As a result, it was possible to form an image of high glossiness on the sheet of rough paper of low glossiness.

When the recording sheet 106 is conveyed in the second conveyance passage 118, it is pressed against the heating roller 1 only at one nip point. Therefore, toner is put into a semi-fusing condition, however, it can be sufficiently fused on the recording sheet 106. Under the above condition, the toner layer contains a number of voids, and the surface of the toner layer is very irregular, so that the glossiness of the image is low. Consequently, when the toner image was fused on a sheet of rough paper, a difference between the glossiness of the recording sheet and the glossiness of the recorded image was small. In order to form an image of low glossiness on a sheet of smooth paper, a toner image was fused on the sheet of smooth paper. As a result, it was possible to form an image of low glossiness on the sheet of smooth paper of high glossiness.

When a recording sheet was conveyed in the second conveyance passage 118, a small quantity of heat was given to the recording sheet. Therefore, when a toner image is fused on an envelope or a postcard, it was possible to provide an excellent fused image having no wrinkles or curls.

Referring to the schematic illustration shown in FIG. 8, the arrangement and operation of another example of the present invention are explained above. According to the arrangement shown in FIG. 8, even if the recording sheet 106 is stopped at the nip portion 102*a* or 108*a* due to the occurrence of jam, the recording sheet 106 could be easily removed when the second pressurizing roller 108 was oscillated to the position 108*b*.

In this connection, it should be noted that the arrangement of the fusing device of the image forming apparatus of the present invention is not limited to the specific embodiments illustrated in FIGS. 5 to 8.

For example, the following arrangement may be adopted. In the arrangements shown in FIGS. 5 to 7, it is temporarily determined that an envelope or postcard is made to pass through a right end portion of the nip 102*a* in the axial direction. The second pressurizing roller group 104 corresponding to the right end portion of the nip 102*a* in the axial direction are not contacted with the heating roller 101 by the length of an envelope or postcard. Due to the foregoing, while the movable guide 103 is not changed over from the first to the second position, the envelope or postcard passes through only the nip portion 102*a*, and a recording sheet that is longer than the envelope or postcard is made to pass through the nip portions 102*a*, 104*a* and 105*a*.

When the above arrangement is adopted, in the case of alternatively fusing envelopes or postcards and sheets of size A4, it is not necessary to change over the position of the movable guide 103. Therefore, it becomes possible to alternatively feed recording sheets and envelopes or postcards at high speed.

In the same manner, when the second pressurizing roller 108 is made to come into pressure contact with the heating roller 101 in such a manner that it can not be contacted with an envelope or postcard in the arrangement shown in FIG. 8, the same effect can be provided.

In the arrangements shown in FIGS. 5 to 7, the second pressurizing roller group 104, the heating roller 101, the first pressurizing roller 102 and the third pressurizing roller 105 are arranged in such a manner that they continue in the longitudinal direction by a distance longer than the maximum width of the maximum size recording sheet 106. Due to the foregoing arrangement, when the maximum size recording sheet 106 is fused, the entire width of the recording sheet 106 is uniformly contacted with the nip portions 102*a*, 104*a*, 105*a*, so that the toner layer can be uniformly heated, fused and compressed. Consequently, when a transparent sheet is used as the recording sheet 106 so as to fuse a toner image on the transparent sheet, it is possible to obtain a uniform transparence on the overall transparent sheet. When the toner image is fused on a sheet of paper, it is possible to obtain a uniform glossiness on the overall sheet of paper.

In the same manner as described above, in the arrangement shown in FIG. 8, the heating roller 101, the first pressurizing roller 102 and the second pressurizing roller 108 are arranged in such a manner that they continue in the longitudinal direction by a distance longer than the maximum width of the maximum size recording sheet 106. Due to the foregoing arrangement, when a transparent sheet is used as the recording sheet 106 so as to fuse a toner image on the transparent sheet, it is possible to obtain a uniform transparence on the overall transparent sheet. When the toner image is fused on a sheet of paper, it is possible to obtain a uniform glossiness on the overall sheet of paper.

Figure 9:
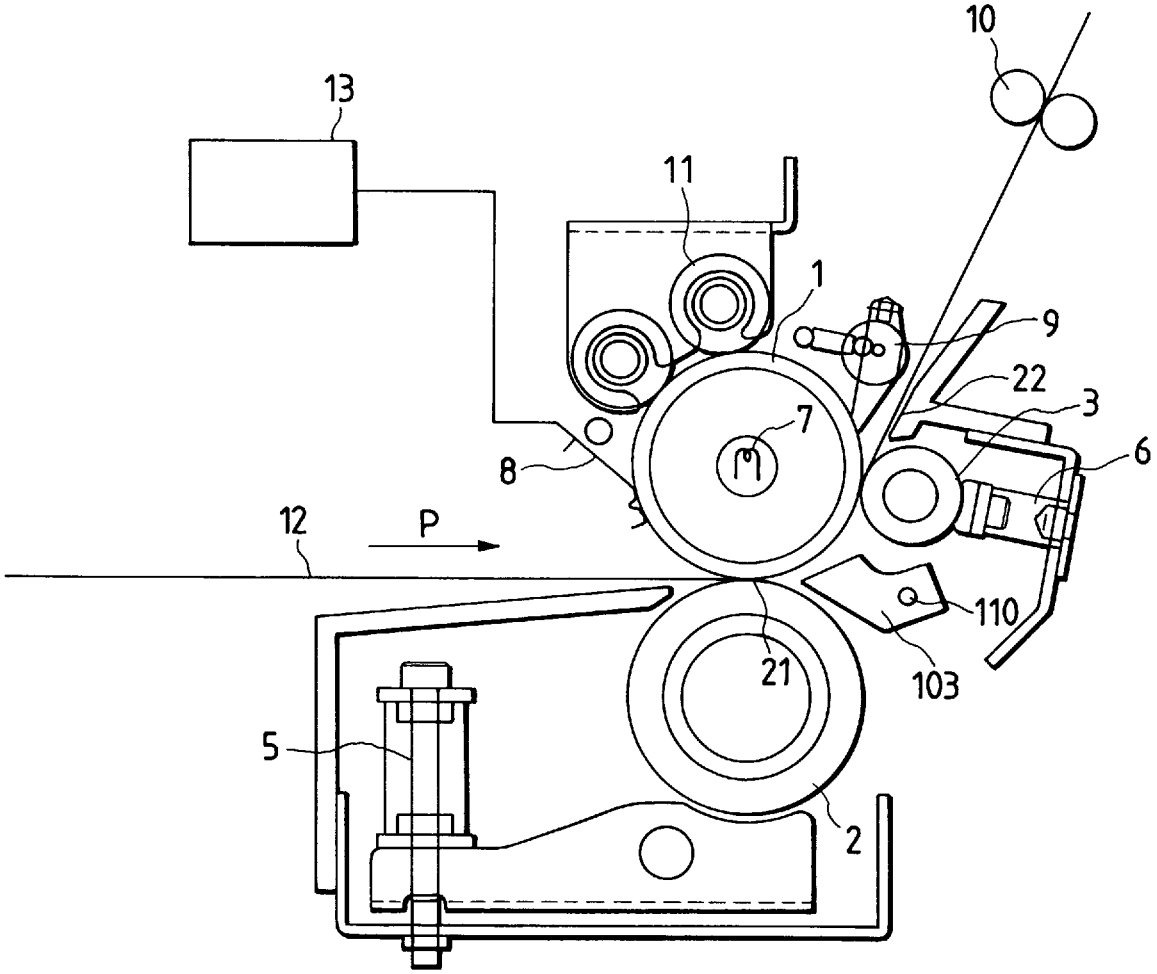
FIG. 9 is a schematic illustration showing another embodiment of the fusing device of the image forming apparatus of the present invention.

Further, the aforementioned embodiments can be combined and incorporated in the image forming apparatus as shown in FIG. 9. The fusing device shown in FIG. 9 is constituted in such a manner that the movable guide 103 in FIG. 7 is incorporated into the fusing device shown in FIG. 1. The similar operations and effects as described in the aforementioned embodiments also can be obtained in this embodiment.

In the fusing device according to the present invention, the first and third rollers are forcibly driven so that the peripheral speed of the third roller is higher than of the first roller. Therefore, the transport speed is stable irrespective of the paper thickness, the surface conditions of the second and third rollers, for example, oil coating conditions, and temperature of the first to third rollers. No slack is caused in the paper between the second and third rollers, and hence deterioration of the fusing/fixing performance is avoided. In addition, no wrinkles and no jams are caused.

Further, by properly controlling a frictional force between each roller and the paper, a proper slip may be caused in the first and second nip portions in accordance with presence or absence of a slack of the paper between the first and second nip portions. Therefore, the image is not disarranged.

The second roller may be also forcibly drive. Accordingly, also when the paper, even if it is thick and large in size (wide), is transported, a braking force by the second roller is effective, so that the freedom of a choice of the surface materials and surface roughness is increased. A good maintenance, high durability and an increased number of fusing operations within which the fusing device can exercise its normal fusing functions is increased.

Further, a second pressure at the second nip portion can be lower than a first pressure at the first nip portion. According to the expression (9), a range to which the coefficients of friction are applicable is enlarged.

Therefore, much freedom of a choice of the surface materials, oil coating conditions, kinds of oils, and viscosities of oil is gained, and the offset performance is improved.

Further, as described above, the present invention is to provide an image forming apparatus in which a toner image is formed on a recording sheet and fused on it when toner is heated by a fusing device, and the fusing device comprises: a plurality of nip portions composed of heating members and pressurizing members; and a change-over means for changing over the number of nip portions through which the recording sheet passes. Accordingly, the following effects can be further provided by the present invention.

It is possible to obtain a fused toner image, the coloring property of which is high.

It is possible to obtain a fused toner image, the transparence of which is high when an image is fused on a transparent sheet.

It is possible to obtain a compact fusing device, the processing speed of which is high, satisfying the above items.

According to the present invention, the change-over means is changed over according to the size information, material information, color mode information and glossiness information of a recording sheet. Therefore, it is possible to select the most appropriate fusing condition for all types of recording sheets.

It is possible to accomplish the formation of a fused image, the glossiness of which is similar to the glossiness of a recording sheet, that is, it is possible to obtain an image on which nobody feels a sense of incongruity.

Fusing is accomplished without causing curls and wrinkles even on a special recording sheet such as an envelope and postcard as well as a sheet of paper.

It is possible to fuse an excellent transparent image on a transparent sheet at the same high speed as that of fusing a toner image on a sheet of plain paper.

According to the present invention, the pressurizing member is made to be movable and used as a change-over means. Therefore, the following effects can be provided.

In the occurrence of sheet jam, the recording sheet can be easily picked up, and the maintenance property of the fusing device is high. It is possible to form a fused toner image of various glossiness on various types of recording sheets. Therefore, the following effects can be provided.

It is possible to obtain an excellent fused toner image according to the type of a recording sheet from the viewpoint of satisfying the preference of a user and improving the design of an image.

What is claimed is:

1. A fusing device for fusing a toner image onto a recording medium, comprising:

a first roller for heating a recording medium;

a second roller pressed against said first roller to form a first nip portion therebetween; and a third roller pressed against said first roller to form a second nip portion therebetween, the recording medium passing through the first and second nip portions, wherein said first and third rollers are forcibly driven so that a peripheral speed of said third roller is higher than of said first roller, and wherein the following condition is satisfied:

$$M1+M1'>M3>M1'$$

M1: frictional force between a surface of said first roller and the recording medium in the first nip portion, M1': frictional force between the surface of said first roller and the recording medium in the second nip portion, and M3: frictional force between a surface of said third roller and the recording medium in the second nip portion.

2. The fusing device according to claim 1, wherein said change-over means is changed over according to material of the recording medium.

3. The fusing device according to claim 1, wherein said change-over means is changed over according to a size of the recording medium.

4. A fusing device for fusing a toner image onto a recording medium, comprising:

a first roller for heating a recording medium;

a second roller pressed against said first roller to form a first nip portion therebetween; and a third roller pressed against said first roller to form a second nip portion therebetween, the recording medium passing through the first and second nip portions, wherein said first and third rollers are forcibly driven so that a peripheral speed of said third roller is higher than of said first roller, and wherein said second roller is forcibly driven so that a peripheral speed of said second roller is lower than of said first roller.

5. The fusing device according to claim 4, wherein the following condition is satisfied:

$$V1<V3\leqq 1.05\times V1$$

$$0.95\times V1\leqq V2\leqq V1$$

V1: peripheral speed of said first roller,

V2: peripheral speed of said second roller, and

V3: peripheral speed of said third roller.

6. A fusing device for fusing a toner image onto a recording medium, comprising:

a first roller for heating a recording medium;

a second roller pressed against said first roller to form a first nip portion therebetween; and a third roller Dressed against said first roller to form a second nip portion therebetween, the recording medium passing through the first and second nip portions, wherein said first and third rollers are forcibly driven so that a peripheral speed of said third roller is higher than of said first roller, and wherein a second pressure at the second nip portion is lower than a first pressure at the first nip portion.

7. A fusing device for fusing a toner image onto a recording medium, comprising:

a first roller for heating a recording medium;

a second roller pressed against said first roller to form a first nip portion therebetween; and a third roller pressed against said first roller to form a second nip portion therebetween, the recording medium passing through the first and second nip portions, wherein said first and third rollers are forcibly driven so that a peripheral speed of said third roller is higher than of said first roller, and wherein the following condition is satisfied:

$$V1<V3<1.05\times V1$$

V1: peripheral speed of said first roller, and

V3: peripheral speed of said third roller.

8. A fusing device for fusing a toner image onto a recording medium, comprising:

a heating member;

pressurizing members pressed against said heating member to form a plurality of nip portions therebetween; and change-over means for changing over the number of the nip portions through which the recording medium passes, wherein said pressurizing members comprise a first pressurizing member to be pressed against said heating member to form a first nip portion therebetween and a second pressurizing member to be pressed against said heating member to form a second nip portion therebetween; wherein said second pressurizing member is changed over between first and second positions, and the recording medium is introduced from the first nip portion to the second nip portion when said second pressurizing member is set at the first position, and the recording medium is made to pass through only the first nip portion when said second pressurizing member is set at the second position so as to also serve as said change-over means.

9. A fusing device for fusing a toner image onto a recording medium, comprising:

a heating member;

pressurizing members pressed against said heating member to form a plurality of nip portions therebetween; and change-over means for changing over the number of the nip portions through which the recording medium passes, wherein said change-over means is changed over according to whether the toner image formed on the recording medium is of mono-color or multi-color.

10. A fusing device for fusing a toner image onto a recording medium, comprising:

a heating member;

pressurizing members pressed against said heating member to form a plurality of nip portions therebetween; and change-over means for changing over the number of the nip portions through which the recording medium passes, wherein said change-over means is changed over according to glossiness of an image that has been fused.

11. An image forming apparatus comprising:

a heating roller for heating a recording medium;

a first pressurizing roller pressed against said heating roller to form a first nip portion therebetween;

a second pressurizing roller pressed against said heating roller to form a second nip portion therebetween; and change-over means being disposed between said first and second pressurizing rollers in a recording medium path, said change-over means changing over the number of the nip portions through which the recording medium passes, wherein said heating and second pressurizing rollers are forcibly driven so that a peripheral speed of said second pressurizing roller is higher than of said heating roller, and wherein the following condition is satisfied:

$$M1+M1'>M3>M1'$$

M1: frictional force between a surface of said heating roller and the recording medium in the first nip portion, M1': frictional force between the surface of said heating roller and the recording medium in the second nip portion, and M3: frictional force between a surface of said first pressurizing roller and the recording medium in the second nip portion.

12. The image forming apparatus according to claim 11, wherein said change-over means comprises a movable guide being set at first and second positions; and the recording medium is guided from the first to the second nip portion by said movable guide when it is set at the first position, and the recording medium is made to pass through only the first nip portion when said movable guide is set at the second position.

13. The image forming apparatus according to claim 11, wherein said change-over means is changed over according to material of the recording medium.

14. The image forming apparatus according to claim 11, wherein said change-over means is changed over according to a size of the recording medium.

15. An image forming apparatus comprising:

a heating roller for heating a recording medium;

a first pressurizing roller pressed against said heating roller to form a first nip portion therebetween;

a second pressurizing roller pressed against said heating roller to form a second nip portion therebetween; and change-over means being disposed between said first and second pressurizing rollers in a recording medium path, said change-over means changing over the number of the nip portions through which the recording medium passes, wherein said heating and second pressurizing rollers are forcibly driven so that a peripheral speed of said second pressurizing roller is higher than of said heating roller, and wherein said first pressurizing roller is forcibly driven so that a peripheral speed of said first pressurizing roller is lower than of said heating roller.

16. The image forming apparatus according to claim 15, wherein the following condition is satisfied:

$$V1<V3\leqq 1.05\times V1$$

$$0.95\times V1\leqq V2\leqq V1$$

V1: peripheral speed of said heating roller,

V2: peripheral speed of said first pressurizing roller, and

V3: peripheral speed of said second pressurizing roller.

17. An image forming apparatus comprising:

a heating roller for heating a recording medium;

a first pressurizing roller pressed against said heating roller to form a first nip portion therebetween;

a second pressurizing roller pressed against said heating roller to form a second nip portion therebetween; and change-over means being disposed between said first and second pressurizing rollers in a recording medium path, said change-over means changing over the number of the nip portions through which the recording medium passes, wherein said heating and second pressurizing rollers are forcibly driven so that a peripheral speed of said second pressurizing roller is higher than of said heating roller, and wherein a second pressure at the second nip portion is lower than a first pressure at the first nip portion.

18. An image forming apparatus comprising:

a heating roller for heating a recording medium;

a first pressurizing roller pressed against said heating roller to form a first nip portion therebetween;

a second pressurizing roller pressed against said heating roller to form a second nip portion therebetween; and change-over means being disposed between said first and second pressurizing rollers in a recording medium path, said change-over means changing over the number of the nip portions through which the recording medium passes, wherein said heating and second pressurizing rollers are forcibly driven so that a peripheral speed of said second pressurizing roller is higher than of said heating roller, and wherein the following condition is satisfied:

$$V1<V3\leqq 1.05\times V1$$

V1: peripheral speed of said heating roller, and

V3: peripheral speed of said second pressurizing roller.

19. An image forming apparatus comprising:

a heating roller for heating a recording medium;

a first pressurizing roller pressed against said heating roller to form a first nip portion therebetween;

a second pressurizing roller pressed against said heating roller to form a second nip portion therebetween; and change-over means being disposed between said first and second pressurizing rollers in a recording medium path, said change-over means changing over the number of the nip portions through which the recording medium passes, wherein said heating and second pressurizing rollers are forcibly driven so that a peripheral speed of said second pressurizing roller is higher than of said heating roller, and wherein said change-over means is changed over according to whether the toner image formed on the recording medium is of mono-color or multi-color.

20. An image forming apparatus comprising:

a heating roller for heating a recording medium;

a first pressurizing roller pressed against said heating roller to form a first nip portion therebetween;

a second pressurizing roller pressed against said heating roller to form a second nip portion therebetween; and change-over means being disposed between said first and second pressurizing rollers in a recording medium path, said change-over means changing over the number of the nip portions through which the recording medium passes, wherein said heating and second pressurizing rollers are forcibly driven so that a peripheral speed of said second pressurizing roller is higher than of said heating roller, and wherein said change-over means is changed over according to glossiness of an image that has been fused.

* * * * *